US008006744B2

(12) United States Patent
Oles

(10) Patent No.: US 8,006,744 B2
(45) Date of Patent: Aug. 30, 2011

(54) METHOD AND SYSTEM FOR DRYING CASTING MOLDS

(75) Inventor: Mark Oles, Francestown, NH (US)

(73) Assignee: Sturm, Ruger & Company, Inc., Southport, CT (US)

( * ) Notice: Subject to any disclaimer, the term of this patent is extended or adjusted under 35 U.S.C. 154(b) by 378 days.

(21) Appl. No.: 12/208,845

(22) Filed: Sep. 11, 2008

(65) Prior Publication Data

US 2009/0071621 A1 Mar. 19, 2009

Related U.S. Application Data

(60) Provisional application No. 60/973,186, filed on Sep. 18, 2007.

(51) Int. Cl.
*B22C 9/04* (2006.01)

(52) U.S. Cl. ..... 164/516; 164/35

(58) Field of Classification Search ..... 164/516–519, 164/34, 35

See application file for complete search history.

(56) References Cited

U.S. PATENT DOCUMENTS

| | | | | |
|---|---|---|---|---|
| 2,932,864 A | | 4/1960 | Mellen et al. | |
| 3,590,905 A | | 7/1971 | Watts | |
| 3,610,314 A | | 10/1971 | Hochgraf | |
| 3,713,475 A | * | 1/1973 | Roelofs et al. | 164/516 |
| 3,755,915 A | | 9/1973 | Nagell | |
| 3,994,346 A | | 11/1976 | Brown | |
| 4,316,498 A | | 2/1982 | Horton | |
| 4,925,492 A | | 5/1990 | Kelkar et al. | |
| 5,259,998 A | | 11/1993 | Reich | |
| 5,335,716 A | | 8/1994 | Takesue et al. | |
| 5,582,231 A | | 12/1996 | Siak | |
| 5,714,110 A | | 2/1998 | Wang | |
| 5,885,493 A | | 3/1999 | Janney | |
| 5,918,662 A | | 7/1999 | Tezuka et al. | |

(Continued)

FOREIGN PATENT DOCUMENTS

GB 1034368 6/1966

(Continued)

OTHER PUBLICATIONS

John Vandermeer, A Unique New Silica Binder for Investment Shell Slurries, 46th Annual Technical Meeting 1998, 8 pages.

(Continued)

*Primary Examiner* — Kuang Lin
(74) *Attorney, Agent, or Firm* — Duane Morris LLP; Frank J. Spanitz

(57) ABSTRACT

A system and method of drying casting molds for forming metal parts is provided. In one embodiment, the method includes providing a casting mold comprised of a meltable pattern coated with a ceramic slurry containing a liquid solvent and a binder, placing the casting mold in a chamber, encapsulating the casting mold in a desiccant material, sealing the chamber sufficient to pull a vacuum in the chamber, and applying a variable vacuum to the chamber to dry the mold. In one embodiment, the vacuum is controlled and gradually increased over time from atmospheric pressure to a predetermined maximum vacuum pressure. The vacuum is preferably applied at a rate such that the meltable pattern has a temperature that does not decrease more than about 5 degrees F. from atmospheric pressure to maximum vacuum pressure in one embodiment. In another embodiment, the retained moisture level of the desiccant may be controlled to minimize temperature swings of the meltable pattern during the vacuum application.

22 Claims, 14 Drawing Sheets

U.S. PATENT DOCUMENTS

| | | | | |
|---|---|---|---|---|
| 6,180,047 | B1 | 1/2001 | Yost et al. | |
| 6,371,197 | B2 | 4/2002 | Weyer et al. | |
| 6,390,179 | B1 | 5/2002 | Yasrebi | |
| 6,481,490 | B1 | 11/2002 | Vihtelic et al. | |
| 6,505,671 | B1 | 1/2003 | McKibben | |
| 6,787,074 | B2 | 9/2004 | Klug | |
| 6,832,493 | B2 * | 12/2004 | Bowden et al. | 65/17.3 |
| 6,920,913 | B2 * | 7/2005 | Yasrebi et al. | 164/517 |
| 6,991,022 | B2 | 1/2006 | Vandermeer et al. | |
| 7,073,557 | B2 | 7/2006 | Franklin et al. | |
| 7,121,318 | B2 | 10/2006 | Grassi | |
| 7,128,129 | B2 | 10/2006 | McGuire | |
| 7,231,955 | B1 | 6/2007 | Bullied et al. | |
| 2002/0109249 | A1 | 8/2002 | Klug | |
| 2006/0108093 | A1 | 5/2006 | Jones | |
| 2007/0209771 | A1 | 9/2007 | Makino et al. | |

FOREIGN PATENT DOCUMENTS

| | | |
|---|---|---|
| GB | 1048720 | 11/1966 |
| JP | 6071384 | 3/1994 |
| JP | 11302088 | 11/1999 |
| WO | WO03037818 A1 | 5/2003 |

OTHER PUBLICATIONS

Dr. Eng, A Pulse Vacuum Mould Drying System (PVD) for Investment Casting, 38th Annual Technical Meeting: Investment Casting Institute 1990, 14 pages.

J.D. Jackson, Drying of Ceramic Shell Molds, 25th Annual Meeting of the Investment Casting Institute, 1977, 25 pages.

Daniel S. McGuire and Eric Hellstrom, The Use of Amorphous Mineral Silicates as a Stucco Additive for Rapid Shell Building, 54th Technical Conference and Expo 2006, 6 pages.

S. Jones, Rapid Shell Build for Investment Casting: Wax to De-Wax in Minutes, The University C Birmingham IRC in Materials Processing, 53rd Technical Conference and Expo 2005, 37 pages.

Bernard Krieger, Martin Yonnone, Alex Galperin and John M. Svoboda, Isothermal Drying of Investment Casting Shells, 42nd Annual Technical Meeting 1994, 22 pages.

* cited by examiner

DRYING COMPARISON
3rd LAYER

| DRYING METHOD | STICK DRY TIME | HOLE DRY TIME | PERCENT OF STANDARD - HOLE |
|---|---|---|---|
| STANDARD AIRFLOW | 51 MINUTES | 79 MINUTES | 100% |
| HIGH VELOCITY AIRFLOW | 40 MINUTES | 57 MINUTES | 72% |
| DESICCANT | 28 MINUTES | 30 MINUTES | 38% |
| VACUUM / DESICCANT | 16 MINUTES | 15 MINUTES | 19% |

FIG. 6B

DRYING COMPARISON
4th LAYER

| DRYING METHOD | STICK DRY TIME | HOLE DRY TIME | PERCENT OF STANDARD - HOLE |
|---|---|---|---|
| STANDARD AIRFLOW | 120 MINUTES | 276 MINUTES | 100% |
| HIGH VELOCITY AIRFLOW | 84 MINUTES | 132 MINUTES | 48% |
| VACUUM / DESICCANT | 24 MINUTES | 30 MINUTES | 11% |

FIG. 7B

METHOD AND SYSTEM FOR DRYING CASTING MOLDS

CROSS-REFERENCE TO RELATED APPLICATIONS

This application claims the benefit of priority to U.S. Provisional Application No. 60/973,186 filed Sep. 18, 2007, which is incorporated herein by reference in its entirety.

BACKGROUND OF THE INVENTION

The present invention generally relates to casting methods, and more particularly to a method of drying ceramic molds such as those used in an investment casting process.

Although a capital intensive and time-consuming process, investment casting employing the lost wax process permits high quality metal parts or components to be produced that include intricate details and configurations. Investment cast parts are used in the firearm, medical device, automotive, aerospace, manufacturing, power generation, oil and chemical, and other enumerable industries. Investment casting initially entails making meltable wax patterns of the metal parts desired to be manufactured by injecting wax in to a metal die. The individual wax patterns are removed and usually attached to a gating system or assembly called a sprue or stick that holds a plurality of patterns. The assembly is then dipped into a ceramic refractory slurry, which in some instances may contain a refractory flour, a colloidal silica binder, a latex polymer, and water which acts as a solvent ("water-based" binder/solvent system). In some applications, "alcohol-based" binder/solvent systems consisting of ethyl silicate and alcohol are used in lieu of colloidal silica and water. The assembly is then drained and dipped into dry refractory grains or "stucco." The assembly is then dried to evaporate the solvent and gel the binder to produce a hardened ceramic "shell" layer. In order to produce a finished ceramic mold of sufficient thickness to ultimately withstand the thermal stresses induced by pouring hot molten metal into the mold to form the desired metal part, the dipping and drying process is repeated multiple times to gradually build up shell layer thickness to produce the final mold. After a ceramic mold of suitable shell thickness has been formed, the mold is dewaxed typically by using a high pressure steam ("autoclave") or in a high temperature oven ("flash fire"). The mold is then heated or fired in an oven to cure or set the refractory material ("sintered"). This leaves a negative impression of the metal part to be cast in the mold. Finally, the preheated ceramic mold is filled with molten metal which solidifies into the shape of the desired parts. The expendable molds are then broken away to yield the cast metal parts.

A typical metal part formed by the foregoing investment casting process may in some instances require the formation of as many as seven shell layers or more of ceramic material to form a refractory mold of sufficient thickness. Because each shell layer must be thoroughly dried between each successive dipping into the ceramic slurry to at least gel the binder, the shell drying time between the multiple layers of ceramic shells significantly contributes to time and cost of producing the cast metal part.

The current industry standard used by foundries for drying the ceramic shell layers is air drying using low humidity, high velocity air. Using this conventional process, it may typically take up to three days or more from the formation of the initial prime ceramic coating or shell layer to the final dewaxing step. For a seven-layer shell, typical representative drying times may be about 2½ hours between layers 1 to 3, about 4 hours for layers 4 to 7, and 48 hours final drying. These drying times illustrate that the time required to dry each successive shell layer increases with the number of layers. Liquids in the ceramic slurry wick into previously dried coats of ceramic material. Therefore, with each successive shell layer built up in the ceramic mold, the required drying time increases because the liquid must travel farther from the previously dried shell layers to the surface of last dipped layer of the mold to be evaporated.

The required drying times are dependent upon factors such as temperature and relative humidity (moisture content) of the drying air, the air velocity, thickness of the ceramic shell layer (gradually increasing upon each successive slurry dipping and shell layer formation), and geometry of the metal part to be cast. For example, drying time increases with increasing relative humidity and vice versa. Lower airflow rates increase drying times. Relatively uniform drying of the ceramic shells is desired. More complex mold geometries and/or the presence of deep holes and slots, however, require longer drying times for the ceramic shells and adversely effect the ability to uniformly dry the shells.

The conventional air drying technique generally involves placing the molds in a temperature and humidity controlled environment, such as a room or enclosure that may incorporate drying fans for airflow control, supplementary heat sources, and humidity controls. The drying rooms are typically controlled to about 30-40% relative humidity to optimize drying times. Airflow requirements may vary from about 100 feet/minute for open and/or featureless molds to about 2,000 feet/minute for molds with deep holes or slots. It will be appreciated that these factors and poor airflow dynamics in drying rooms make it difficult to effectively control the drying rate and temperature of the ceramic shells, and to uniformly dry the molds.

Ideally, the ceramic shell drying process should also be controlled to minimize the temperature decrease of the wax pattern during drying. Stresses are created during drying because of differential thermal expansion between the wax and the ceramic shell material. For example, a temperature change from 70 to 100 degrees F. results in about 0.5% linear expansion for wax, but only less than 0.05% linear expansion for the ceramic. Accordingly, the more the wax cools during drying due to solvent evaporation, the larger the resulting stresses induced in the ceramic mold. High stresses can create detachment of the ceramic from the wax patterns "prime coat lift." This produces castings that are scrap or require salvage to meet customer requirements. High stresses can also create cracks in the ceramic mold. These cracks, if not detected after dewaxing, can leak metal during pouring. Ideally, it is desirable to maintain as constant a wax temperature as possible and minimize temperature fluctuations to within a few degrees of ambient temperature.

Several alternative approaches have been identified to remedy the past problems associated with the conventional shell air drying method technique. These approaches, however, all have drawbacks. One such alternative technique is an elevated air temperature process in which the temperature and humidity of the air are closely controlled to maximize drying rate and minimize wax temperature change. Although this process can reduce shell layer drying time, it is cumbersome to implement. To set up a suitable program, a variety of wax patterns must be monitored to develop drying curves for optimizing the temperature and humidity process controls.

Another alternative drying approach to conventional air drying is the use of desiccants to improved the liberation of moisture from the ceramic shells. Such a system is shown in U.S. Pat. No. 3,755,915. However, desiccants which typically come in a granular form, are sometimes difficult to uniformly work into deeper apertures or recesses in the ceramic shell molds. In addition, such known systems failed to address the problems of mold heat gain that occurs during the moisture removal process with desiccants. Desiccants will actually generate heat due to the heat of adsorption principle involved as the desiccant adsorbs liquid from the ceramic molds. This may increase the temperature of the wax pattern to a point greater than desired to avoid damaging the molds.

Yet another alternative drying approach to conventional air drying is vacuum drying of ceramic shells. Although a vacuum conceptually would increase moisture removal from the ceramic shell and decrease the drying time, it concomitantly greatly increases evaporative cooling rates resulting in larger than desired temperature drops in the wax pattern. Accordingly, the vacuum process must be augmented by supplying external heat (e.g., microwave energy, radio frequency, cyclic vacuum with hot air purging, etc.) to counter-balance the ceramic shell heat loss and attempt to maintain a relative constant wax pattern temperature. Such processes are generally expensive, not readily adapted to commercial scale and production rates, requires additional equipment and capital, and increases energy consumption resulting in higher operating costs.

Accordingly, an improved method of drying ceramic shells in the casting process is desired.

SUMMARY OF THE INVENTION

A system for and method of drying casting mold shells is provided that overcomes the drawbacks of known drying techniques described herein. In a preferred embodiment, the method includes using the combination of a vacuum and desiccant for improving drying performance while controlling the temperature change in the wax to within acceptable levels that avoid damaging the mold. Advantageously, the preferred vacuum-desiccant system and method reduces mold drying times while concomitantly balancing heat lost from the system through evaporative cooling of the mold in the vacuum with the heat liberated and gained from the desiccant during liquid removal from the mold without the need for using supplemental sources of heat. Accordingly, the overall casting process benefits from reduced mold drying time intervals, less temperature change in the wax pattern, and elimination of additional operating and equipment costs typically associated with providing an externally-powered source of heat, and higher operating efficiency compared to known drying methods. In a preferred embodiment, the vacuum level or pressure is carefully controlled and gradually increased over time from atmospheric pressure to a predetermined maximum pressure to balance the heats and maintain the temperature of the wax pattern to within an acceptable range for preventing damage to the pattern and/or casting molds.

According to one embodiment, a method for drying casting molds includes: providing a wet casting mold comprised of a meltable pattern having a ceramic liquid slurry coating thereon; encapsulating the casting mold in a desiccant material; applying a first constant vacuum level to the desiccant and casting mold; holding the first vacuum level for a first period of hold time; applying a second vacuum level to the desiccant and casting mold higher than the first vacuum level, the second vacuum level being different than the first vacuum level; and holding the second constant vacuum level for a second period of hold time longer than the first period of hold time to produce a hardened shell.

According to another embodiment, a method for drying casting molds includes: providing a casting mold comprised of a meltable pattern coated with a ceramic slurry containing a liquid solvent and a binder; placing the casting mold in a chamber; encapsulating the casting mold in a desiccant material; sealing the chamber sufficient to pull a vacuum in the chamber; and applying a variable vacuum to the chamber, the vacuum being controlled so that the vacuum gradually increases from atmospheric pressure to a maximum vacuum pressure such that the meltable pattern has a temperature that preferably does not decrease more than 6 degrees F. from atmospheric pressure to maximum vacuum pressure, and more preferably not more than 5 degrees F.

According to another embodiment, a method for forming and drying an investment casting mold includes: providing a wax pattern of a metal part to be cast; applying a ceramic slurry coating to the pattern containing a liquid solvent to define a wet casting mold; encapsulating the casting mold with a desiccant material; and applying a vacuum to the casting mold for a total vacuum time measured from atmospheric pressure to a maximum vacuum pressure, wherein the vacuum is applied at a rate such that approximately 24% of the total vacuum time is used to increase the vacuum by approximately 75%.

According to another embodiment, a method for forming and drying an investment casting molds includes: providing a meltable wax pattern of a metal part to be cast; applying a ceramic slurry coating to the pattern containing a liquid solvent to form a wet casting mold; fluidizing a bed of unheated desiccant at ambient room temperature; immersing the casting mold in the bed of desiccant; applying a controlled variable vacuum to the casting mold over a period of time, the vacuum being controlled to gradually increase from atmospheric pressure to a maximum vacuum pressure such that the wax pattern maintains a temperature that does not decrease more than 5 degrees F. from the temperature of the pattern at atmospheric pressure.

BRIEF DESCRIPTION OF THE DRAWINGS

The features of the preferred embodiments will be described with reference to the following drawings where like elements are labeled similarly, and in which:

FIGS. 6A-B and 7A-B show drying performance results of tests comparing a preferred vacuum-desiccant shell or mold drying system and method according to the present invention with known prior art shell drying techniques;

DESCRIPTION OF PREFERRED EMBODIMENTS

Figure 2:
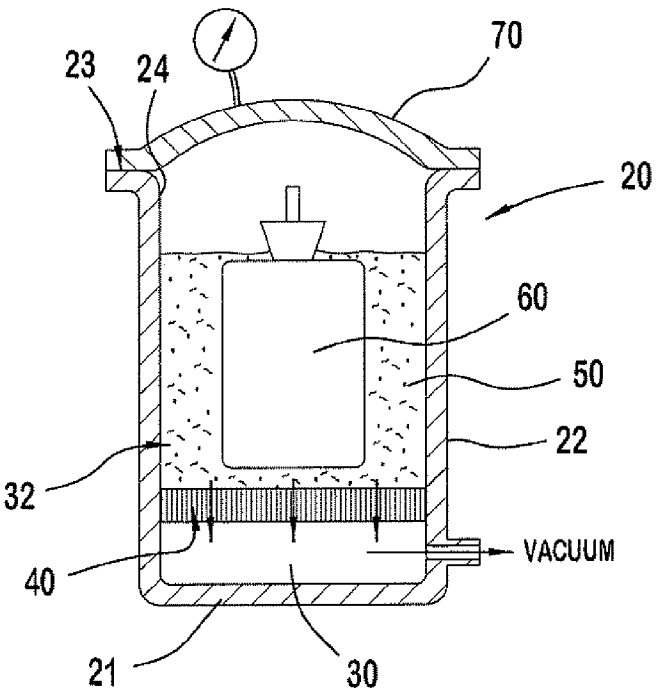
FIGS. 1-5 shows an embodiment of a vacuum-desiccant shell or mold drying system and steps of a method for drying casting shells or molds in accordance with principles of the present invention.

The features and benefits of the invention are illustrated and described herein by reference to preferred embodiments. This description of preferred embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected" and "interconnected," refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

As used herein, the terms "shell," "layer," "coat," "mold", and combinations and derivatives thereof refer to the coating of ceramic material formed on a wax pattern of a part to be cast, during any part of the investment casting process, and/or in any condition such as wet (aka "green"), partially dried, fully dried, or heated/cured. Accordingly, the foregoing terms are used interchangeably as representative expressions and the invention is not limited by the use of any particular term in describing preferred embodiments of the drying process. As used herein, the terms "less," "low," or "lower" with respect to vacuum level refers to a decreasing vacuum and smaller departure from atmospheric pressure while the terms "greater," "high," or "higher" with respect to vacuum level refers to an increasing vacuum and larger departure from atmospheric pressure.

Figure 1:
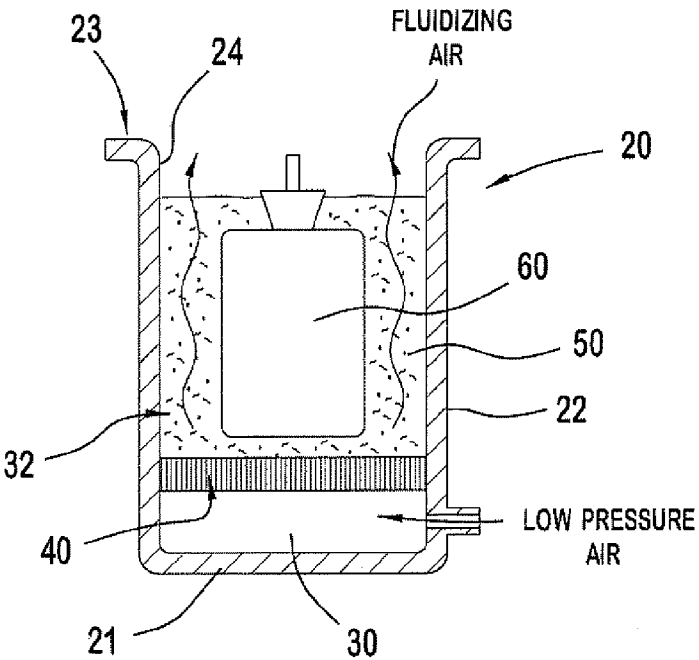

According to principles of the present invention, a preferred embodiment for drying casting molds is provided in the form of a vacuum-desiccant system and related method. FIG. 1 diagrammatically shows one possible exemplary construction of a vacuum chamber or vessel 20, in the form of a fluidized bed container in one possible embodiment, that may be used with the preferred vacuum-desiccant system. It will be appreciated that vacuum vessel 20 may be of any suitable size, shape, materials, or construction depending on the number and/or size of casting molds to be simultaneously dried together. For simplicity and clarity of description, a single casting mold (which may consist of a plurality of wax patterns) is depicted. However, it will be commercially advantageous to concurrently process and dry a plurality of casting molds in a single vessel in some instances (see, e.g. FIG. 9).

Referring to FIG. 1, a casting shell or mold drying vacuum vessel 20 includes base 21, sidewalls 22 rising therefrom, and a top 23 defining an opening 24 for inserting and removing molds from the vessel. Vessel 20 thus defines an internal cavity 25 for receiving and holding a mold 60, desiccant 50, and other appurtenances and materials required to implement the preferred vacuum-desiccant drying method. Vessel 20 preferably includes an air distribution-return means for distributing pressurized air to and collecting air from the vessel. In one possible embodiment, the air distribution-return means may be an air plenum 30 which functions to both distribute air into the vessel when positively pressurized air is supplied to the plenum from an external source and to collect or draw air from the vessel when a vacuum source is connected to the plenum. The pressurized air may be supplied to plenum 30 by any suitable commercially-available pressurized air supply equipment such as a blower, air pump, air compressor, etc. In some embodiment, the pressurized air supply equipment may include a controllable dehumidifier to control the moisture content of the air being supplied to vessel 20. The vacuum source may be provided by any suitable commercially-available equipment, such as without limitation a vacuum pump. It will be appreciated that means other than a plenum may be used to distribute air to or collect air from the vessel 20, such as air distribution pipes or headers, etc. Accordingly, the invention is not limited to the use of a plenum alone, which represents merely one preferred embodiment.

With continuing reference to FIG. 1, an intermediate and preferably porous divider 40 may be disposed in vessel 20 to form the top of plenum 30. Divider 40 is preferably spaced vertically apart from base 21 to define plenum 30 as shown. In a preferred embodiment, divider 40 may be oriented substantially horizontally in vessel 20. In some possible embodiments, divider 40 may be in the form of a porous stone, plate, or other suitable material that is capable of providing bidirectional airflow into and out from plenum 30 for supplying pressurized air or drawing a vacuum on the active drying compartment 32 located above divider 40. Preferably, divider 40 is constructed such that it may support a bed of desiccant 50 above plenum 30. The pore size of divider 40 is selected to be large enough to permit the passage of sufficient airflow in either direction, while concomitantly being small enough to prevent the grains or particles of desiccant from either becoming trapped in the divider or falling through into plenum 30.

Preferably, vessel 20 is designed and constructed with materials, thicknesses, and/or reinforcements such as stiffeners as required to provide sufficient structural strength to place the vessel under vacuum. In a preferred embodiment, vessel 20 has sufficient structural strength to withstand pulling a vacuum of at least 29" Hg. However, it will be appreciated that vacuums less than or greater (higher) than 29" Hg may be used depending on the particular drying application and required operational parameters necessary for proper drying of the molds or shells. Vessel 20 may further be of any suitable configuration such as without limitation cylindrical, square, rectangular, etc. so long as a vacuum may be pulled.

Referring to FIG. 2, vessel 20 is shown with a removable or openable cover 60 installed thereon. Cover 60 is preferably sealable to vessel 20 by any suitable means such as gaskets, clamps, etc. to form a pressure/vacuum vessel capable of handling positive pressures and vacuums that may be used in a particular casting mold drying application. Preferably, vessel 20 is versatile and capable of handling a range of positive pressures and vacuums since the actual pressures/vacuums encountered for the casting mold drying process may vary with the mold shape, thickness, overall size, and number of molds being processed depending on the cast metal part(s) being molded.

Vessel 20 may further be fitted with any suitable number and types of pressure and temperature measurement equipment and instrumentation to allow the drying process to be monitored and controlled. In one embodiment, the measurement equipment and instrumentation may be connected to a computer control system having a programmable logic controller (PLC) implementing control logic that monitors and controls the shell drying process based on data collected by the instrumentation.

One embodiment of a method for drying casting shells or molds according to principles of the present invention will now be described with reference to FIGS. 1-3, 4A, 4B, and 5. In this embodiment, the vacuum drying system employed with the preferred mold drying process includes a vacuum pumping system, a desiccant fluidization system, and a desiccant regeneration system as further described herein. It should be noted that the vacuum-desiccant mold drying process may be used without limitation for drying any of the layers of ceramic material that may be needed form a completed casting mold, from the first prime coat of material applied to the wax pattern to any subsequent coats.

In the first preliminary coating steps during the conventional investment casting process, a sprue containing one or more bare wax patterns or wax patterns already having one or more previously dried ceramic shell layers formed thereon is dipped into a liquid ceramic slurry and coated. In a preferred embodiment, a water-based binder/solvent system consisting of colloidal silica and water is used. However, an "alcohol-based" binder/solvent systems consisting of ethyl silicate and alcohol may alternatively be used instead. The coated wax pattern(s), which will be collectively referred to as a mold in description of the process from this point forward, is removed from the slurry and then dipped into dry refractory grains or stucco adhering the stucco to wet slurry. Alternatively, if a final smooth seal coat is being created prior to dewaxing, the coated wax pattern would not be dipped into the stucco.

Preferably, mold 60 is next allowed to partially air dry in some embodiments for an exemplary period of at least 10 about to 20 minutes or more without limitation before surrounding or encapsulating the mold in desiccant and applying a vacuum. It will be appreciated that duration of the air drying time may be varied as required and can be affected by airflow, temperature and humidity. Ideally, enough water is preferably removed from the shell during this initial air drying to at least partially gel the casting shell for reasons described below. The gel point can be changed through the use of various levels and types polymers and binders. This preliminary air drying step provides several benefits. First, the relatively short air dry period evaporates some of the liquid (e.g., water or alcohol) from the wet shell layer which increases green strength to prevent damaging the shell when placing it in vessel 20 and the desiccant. In addition, the partially solidified shell layer begins to gel which helps retain the stucco better and prevent it from rubbing off (i.e. stucco abrasion) during encapsulation of the mold in the desiccant. In addition, if the shell layer is the final smooth seal coat without the stucco dip, the partial air dry will help minimize desiccant particles from becoming permanently embedded into or adhering to the shell coat when the mold is encapsulated in the desiccant. According, it is well within the skills of those skilled in the art to determine a sufficient duration for the initial air drying step to achieve the foregoing objectives.

It will be appreciated that air drying is not a necessity if encapsulation can be conducted without abrasion. Also, a seal dipped final layer is not a requirement for all molds, and some foundries use stucco on the final layer. Accordingly, if the mold can be encapsulated in desiccant correctly without stucco abrasion, the molds do not need to be air dried in some embodiments of the mold drying process. There are potential drawbacks to air drying which must be considered. First, during air drying, externally exposed areas of the mold dry much faster than unexposed slots and holes. The longer the mold is allowed to air dry, the larger the difference in dryness level becomes the exposed areas and the holes/slots. This difference must be compensated for during vacuum application. If the molds can skip preliminary air drying, the exposed and unexposed areas dry at essentially the same rate. Second, air drying complicates handling of the molds and the mold drying system. Finally, air drying typically produces the largest wax temperature drop in the entire drying cycle. Accordingly, the use of first air drying the molds at all, or if required, the duration of the air drying requires a balancing of the foregoing considerations.

Mold 60 is now ready for the vacuum-desiccant drying process and steps that follow whether initial air drying of the mold is used or not.

Step 1. Referring now to FIG. 1, vacuum drying vessel 20 is prepared to receive partially dried mold 60 by first supplying low pressure, room temperature air via a blower or similar means to plenum 30 for fluidizing the bed of desiccant 50 therein. The blower should have sufficient pressure and flow capabilities to effectively fluidize the bed of whatever type and size desiccant is selected for use. In some embodiments, desiccant 50 may be silica gel, Sorbead, activated alumina, or molecular sieve. However, any other suitable desiccant may be used depending on the particular drying requirements encountered. In one possible embodiment, the bed may be comprised of ⅛" diameter desiccant beads. However, desiccant beads of any suitable size may be used depending on the application and mold configuration.

Step 2. Next, mold 60 is inserted into vessel 20 and immersed into the fluidized desiccant 50 to encapsulate the mold in desiccant, as shown in FIG. 1. The fluidic motion of the desiccant 50 allows the desiccant to migrate into the various holes or recesses that may be present in mold 50 and encapsulate the mold. Any suitable commercially-available desiccant may be used.

Step 3. Referring to FIG. 2, after mold 60 has been sufficiently encapsulated by desiccant, the blower is turned off to stop the flow of fluidizing air to the desiccant bed.

Step 4. With continuing reference to FIG. 2, vacuum vessel 20 is next closed and sealed, such as by attaching and securing cover 60 to the vessel. A vacuum is then applied to vessel 20 to increase the evaporative rate from mold 60 whereby the moisture removal process and drying of the mold has been initiated. The vacuum may be created by any suitable commercial means as will be known to those skilled in the art, such as by providing a vacuum pumping system in one possible embodiment that is connected to air plenum 30. The vacuum is held for a sufficient amount of time ("hold time") necessary to adequately dry mold 60 so that the binder in the refractory slurry mixture gels and the ceramic shell hardens and gains strength. It should be noted that all water need not be removed from mold 60 to sufficiently dry and harden the shell. During the drying process, the shell will undergo some shrinkage as the retained water is removed thereby causing the interstitial spaces between the ceramic particles to be reduced.

The hold time that is required for applying a vacuum to dry mold 60 can readily be determined by those skilled in the art using any suitable known techniques. For example, in situ dryness measurements for mold 60 can be made while the mold is being dried under vacuum in vessel 20 by measuring various process parameter associated with the wax pattern and/or casting shell. In one embodiment, for example, the wax temperature may be monitored by embedding temperature probes such as a thermocouple or thermistor in the wax pattern and measuring the effect of evaporative cooling on the wax temperature. The temperature probes generate electrical signals which can be captured and translated into temperatures by commercially available converters or a computer. When the temperature change of the wax remains relatively constant within a few degrees, this is indicative that the majority or most of the liquid or water has been effectively removed from the casting mold and that the mold is dry for practical purposes of continuing the additional shell formation or final wax removal process. Alternatively, the conductivity in the shell may be measured by embedding probes in the wax pattern or between layers of the ceramic shell. These probes measure voltages which can be correlated to degrees of dryness since electrical resistance increases with a corresponding decrease in water content in mold 60. Other suitable techniques may be used to measure the dryness of mold 60 and determine required vacuum hold time. Alternatively, predetermined hold times can be used for a given configuration and type of casting shell, which are empirically derived from conducting prior dryness tests and measurements. It will be appreciated that the hold time necessary to dry the shells or molds will vary based on a number of factors, including the total thickness of the present and any preexisting shell coats on the wax pattern, the configuration of the shell including presence and depth of any holes and recesses, the type of desiccant used, the level of vacuum placed on vessel 20, etc.

Figure 3:
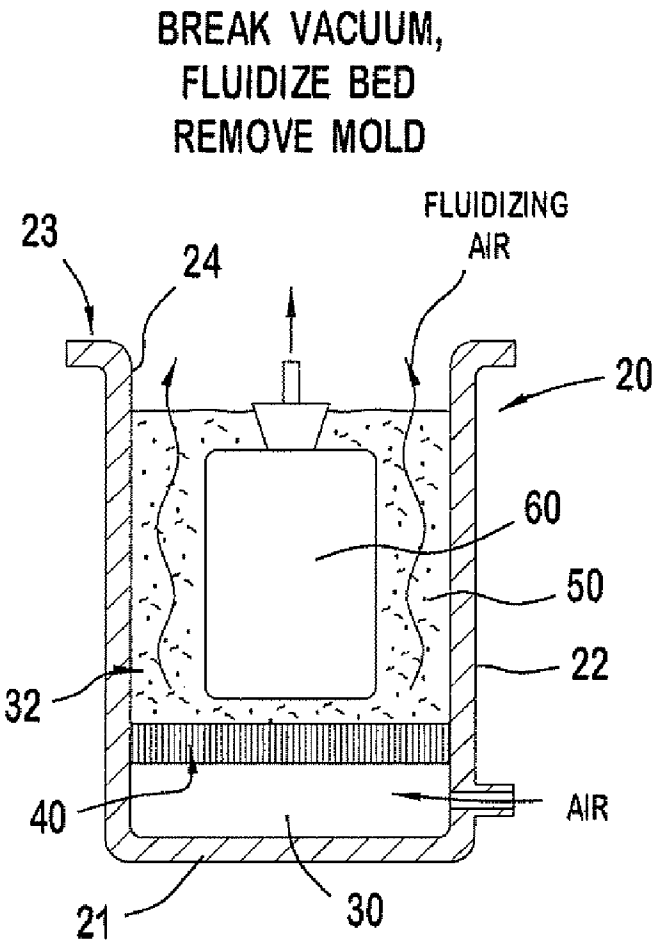

Step 5. Next, after the mold has reached the desired level of dryness, the vacuum pumping system is stopped and vessel 20 is returned to atmospheric pressure. This may be accomplished in any number of ways, such as without limitation by allowing ambient air to infiltrate into the vessel via a valved opening therein or other similar means. After the pressure has been equalized, cover 60 may then be removed to gain access to mold 60 as shown in FIG. 3.

Step 6. Optionally, but preferably, low pressure air flow may be restarted to plenum 30 to again fluidize the bed of desiccant 50, which assists in loosening the desiccant from mold 60. The dried mold 60 is then removed from vessel 20.

Figure 4A:
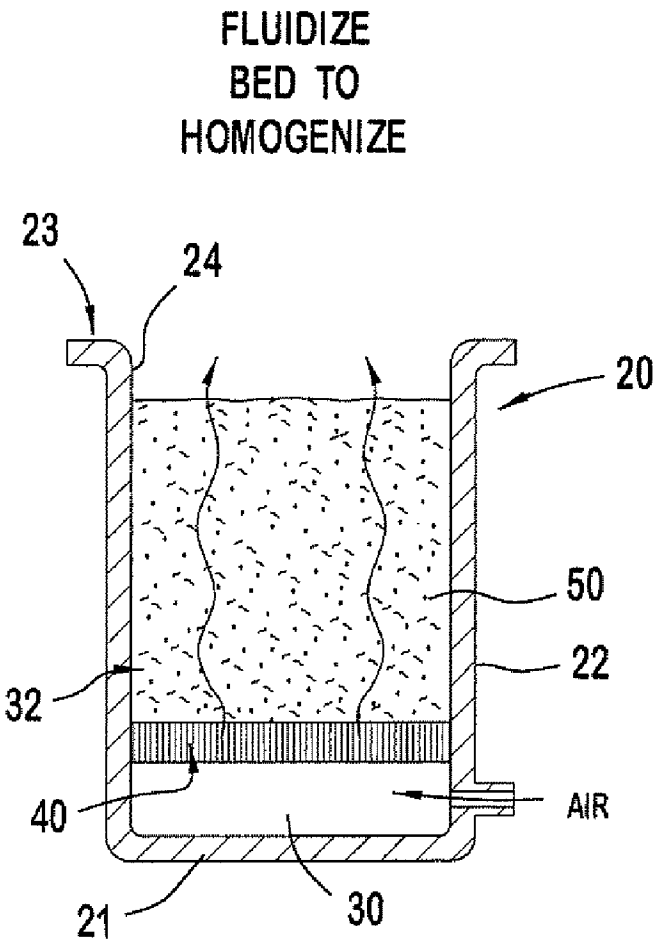
Figure 5:
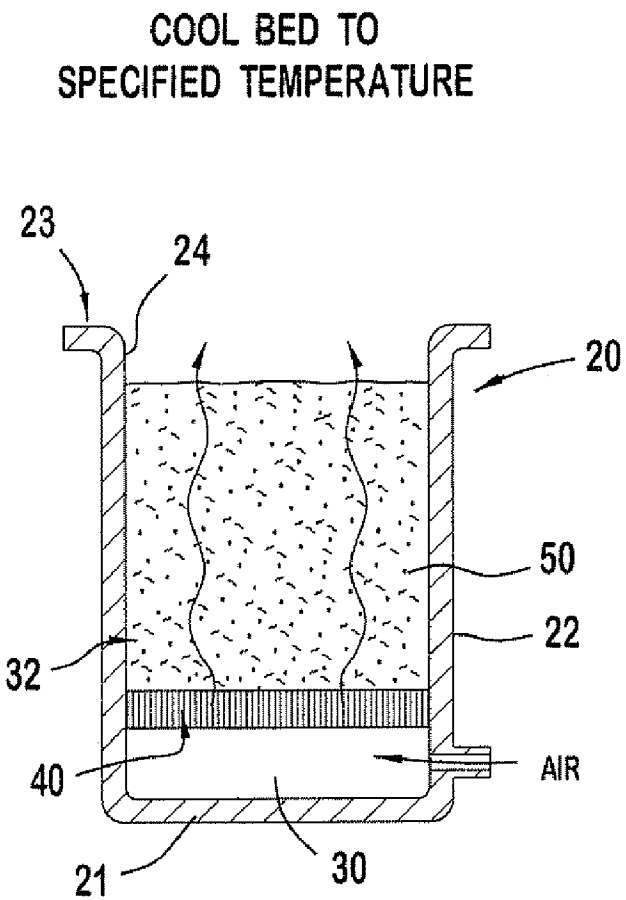
Figure 4B:
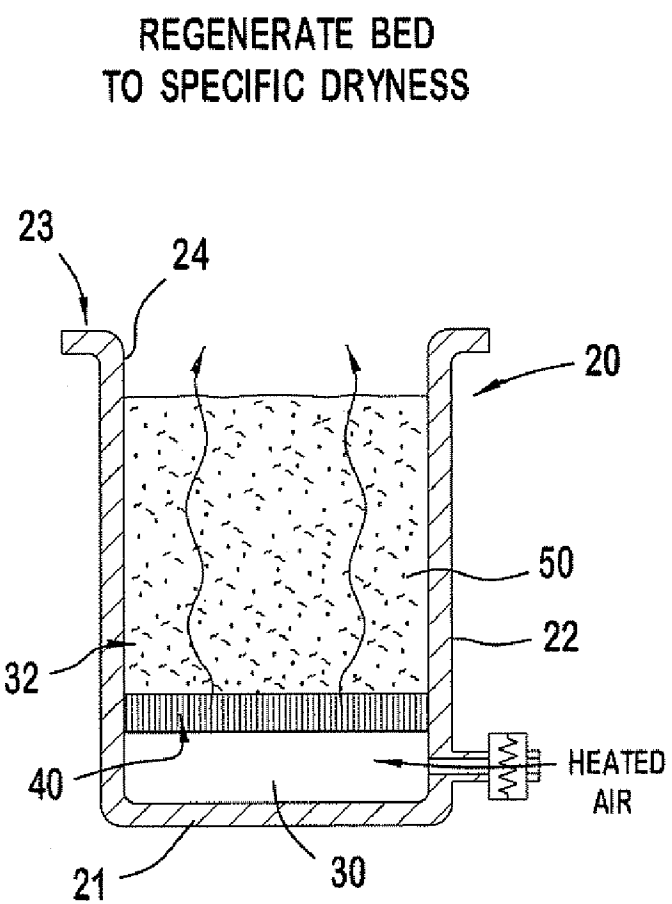

Step 7. Referring to FIGS. 4A and 4B, there are at least two options which may be followed next in the process depending on the particular mold drying application and conditions encountered. In some instances, it may not be necessary to regenerate the bed of desiccant depending on the water holding capacity of the particular desiccant used and the size of the desiccant bed. For example, the desiccant bed may not need regeneration for the first 3-4 shell layers formed based on tests performed using the vacuum-desiccant method. Therefore, referring to FIG. 4A, if the desiccant 50 is not completely saturated with water and does not require regeneration (i.e. full or partial moisture removal) for the next drying cycle, the bed of desiccant 50 may simply be fluidized using low pressure, room temperature air to homogenize the desiccant wet and dry desiccant beads and evenly redistribute the moisture content of the bed. The bed of desiccant 50 may be further cooled if necessary as shown in FIG. 5 by continuing the air flow to lower the bed to the required temperature specified for the particular process application. The vacuum drying system is now ready to begin another drying cycle starting over with Step 1.

Alternatively, if the bed of desiccant 50 requires partial or full regeneration for the next drying cycle, heated air which typically may be at about 300-500 degree F. (depending on the type of desiccant used) is introduced into plenum 30 by a desiccant regeneration system, which may include a heated air blower. The heated air flows through the desiccant and elevates the desiccant bed temperature to evaporate the water trapped in the desiccant 50. After the desiccant bed has been regenerated to the desired moisture level, the desiccant 50 may then be cooled as shown in FIG. 5 to the required temperature specified by flowing unheated, room temperature air through the desiccant. Preferably, the desiccant is unheated and at ambient temperature prior to the start of the vacuum cycle to avoid overheating the wax pattern during the vacuum-desiccant drying step. The vacuum-desiccant drying system is now ready to begin another drying cycle for another mold starting over with Step 1.

Figure 9B:
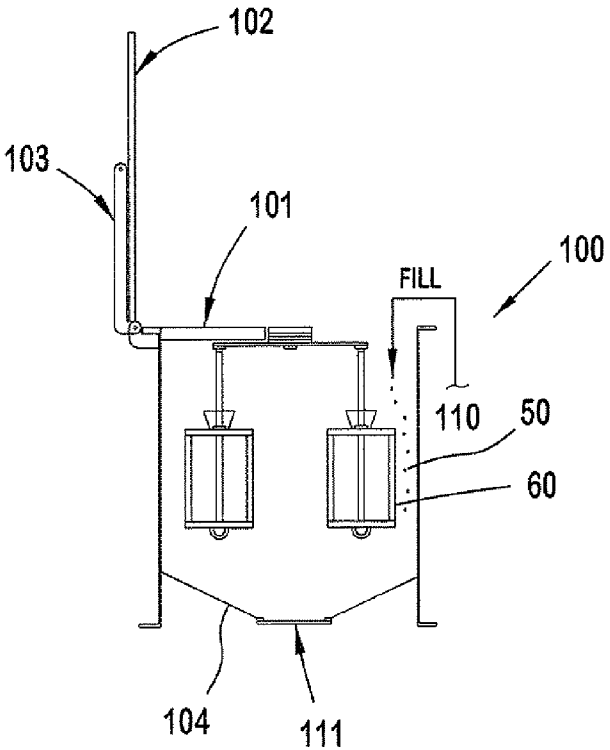
FIG. 9 shows another alternative embodiment of a vacuum-desiccant mold drying system and method for drying casting shells or molds according to the present invention.
Figure 9A:
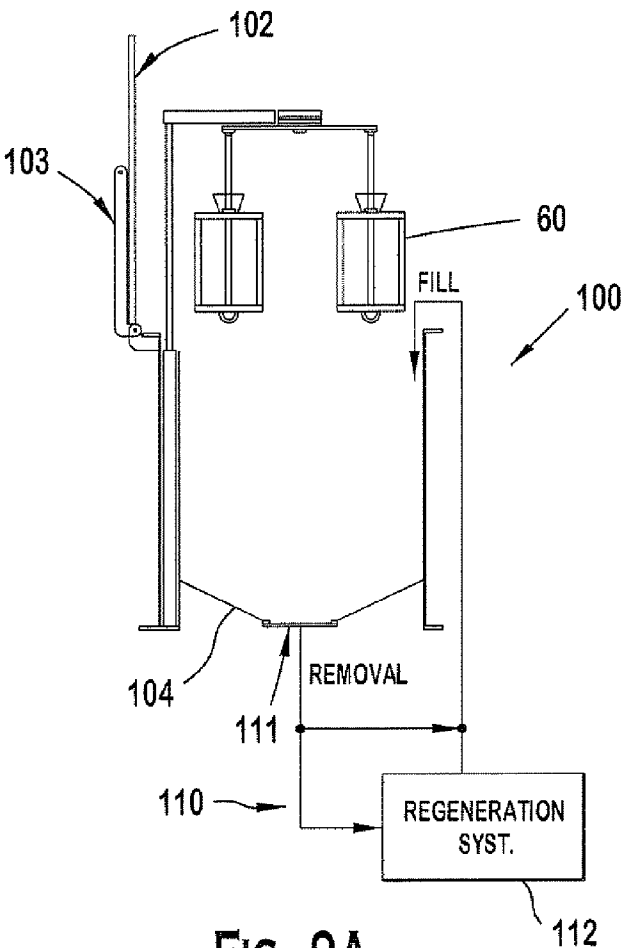
Figure 9D:
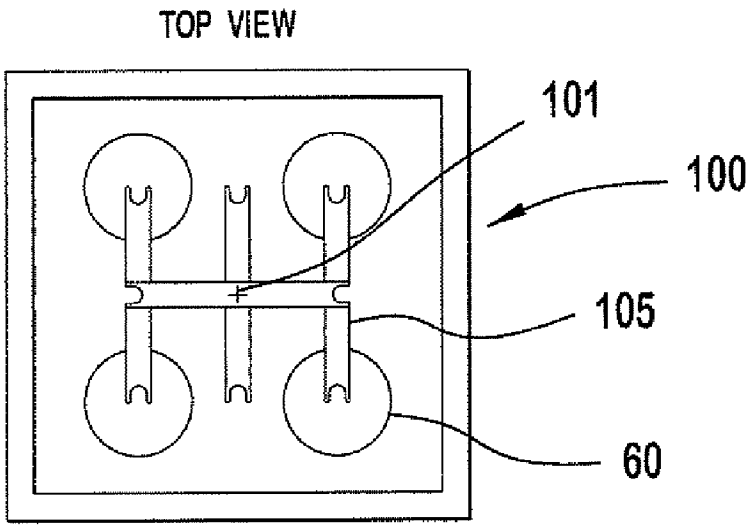
Figure 10:
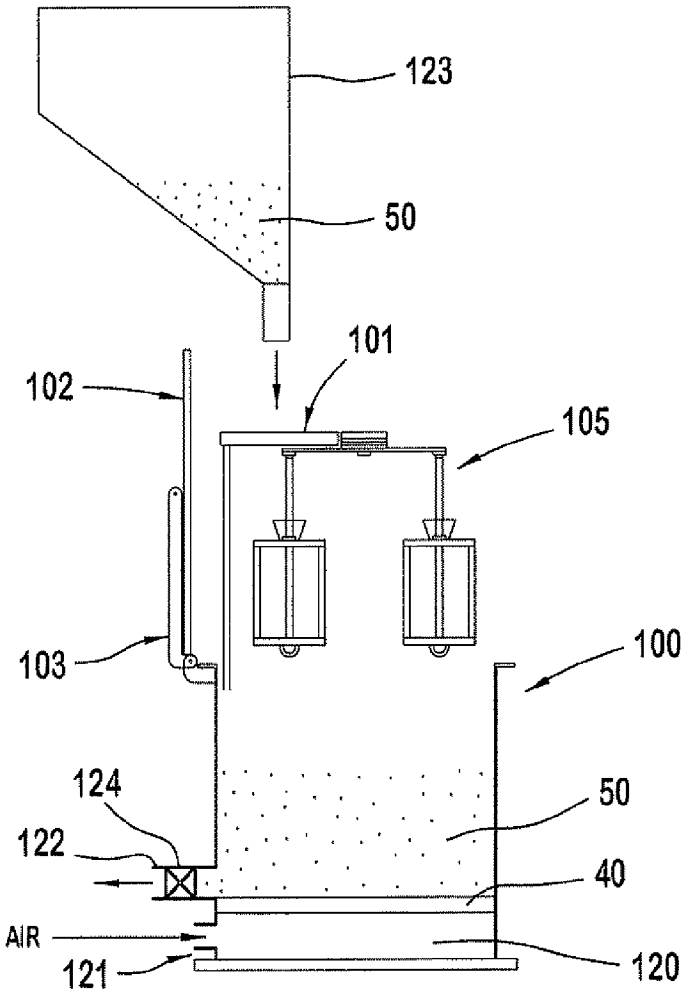
FIG. 10 shows an alternative embodiment of a vacuum vessel with external desiccant regeneration.

In other alternative embodiments, as shown in FIG. 10, a second alternative to in situ desiccant regeneration previously described herein is to partially or fully discharge the desiccant to a separate external central regeneration system. FIG. 10 shows vacuum vessel 100 having sealable lid 102, lid operator 103 for opening/closing the lid, and a mold hanger 101 for supporting a plurality of mold assemblies 105. Vessel 100 includes an air plenum 120 capped with a porous plate 40 for receiving pressurized air to fluidize the bed of desiccant 50 as generally described herein with reference to FIGS. 1-4B. A desiccant drain pipe assembly 122, which may include a valve 124, is provided at the bottom of the vessel 100 preferably just above the porous plate 40 to allow removal of desiccant 50 from the tank. When it has been determined that desiccant 50 requires regeneration, the regeneration process would involve fluidizing the desiccant 50 bed and opening valve 124 to allow the desiccant to be removed from vessel 100 and transported to a remote external regeneration system such as regeneration system 112 shown in FIG. 9A. Regenerated desiccant may then be added from a desiccant refill hopper 123, positioned above vessel 100, to refill the vessel with previously regenerated desiccant. Since stucco and/or broken pieces of molds may accumulate in vacuum vessel 100 over time, the external regeneration system would provide the opportunity to remove such debris from the vessel. Preferably, the desiccant 50 removed from vessel 100 is sifted to removed the foregoing debris prior to reaching the external regeneration system.

Preferably, it is desirable to balance the heat gained and lost by mold 60 (and concomitantly the wax pattern encapsulated therein) during the vacuum-desiccant shell drying process to prevent large temperature swings in the wax which may crack the mold or cause the wax pattern to separate from the primary shell coat. Desiccant 50 generates heat as it adsorbs water from mold 60 by virtue of the heat of adsorption principle under which it operates. Conversely, mold 60 loses heat by evaporative cooling by virtue of the heat of evaporation as it dries. The vacuum increases the evaporation rate in contrast to conventional air drying at atmospheric pressure and would overcool the mold and wax pattern if heat is not added back to the mold during the process. The heat of adsorption is generally greater than the heat of evaporation, therefore there is a net heat gain during operation of the vacuum drying system. Accordingly, the heat gain and loss of mold 50 preferably may be balanced and controlled by varying the amount of vacuum applied to vessel 20 to minimize swings in wax pattern temperature (increase or decrease) which will decrease the likelihood of damaging the mold (i.e., cracking or separation of wax from the primary shell coat or layer). The amount of heat gain experienced by the mold and wax pattern is also dependent in part on the type of desiccant being used since moisture adsorption performance and concomitantly the amount of heat generated can vary by the type of desiccant being used. Therefore, the selection of desiccant type can be varied to help achieve an appropriate vacuum drying heat balance for vessel 20.

It will be appreciated that in certain circumstances, it may be desirable to only partially regenerate the desiccant bed (i.e. partial water removal) after each or a selected number of drying cycles as an additional means of controlling the vacuum process and balancing the heats in vessel 20. The water holding capacity of desiccant 50 decreases with continued use. Therefore, the amount of heat generated by adsorption of water from mold 60 will be correspondingly lower for a partially saturated bed of desiccant than fully regenerated and dry desiccant. This provides one means of minimizing the temperature increase or decrease of the wax pattern, which typically occurs in the vacuum-desiccant drying system following an initial temperature decrease (see, e.g. FIG. 8) when the heat of evaporation exceeds the heat of adsorption. Accordingly, by controlling both the vacuum level and rate of change applied to vessel 20 and the retained moisture level (if any) of a partially regenerated desiccant bed, the temperature change of the wax pattern can be controlled and maintained to within the desired range for preventing damage to the mold. Importantly, therefore, the level of moisture in the desiccant bed being either in a fully regenerated condition (with little or no retained moisture) or partially regenerated condition with varying degrees of retained moisture should be carefully controlled along with the rate at which vacuum is applied in the preferred process to balance the heats for maintaining the desired temperature range of the wax pattern.

In theory, the evaporation temperature of water is dependent on absolute pressure which affects the vacuum level selected for application to vessel 20 during various states of mold drying. In general, there are three commonly recognized stages of drying and each stage influences the ease of water or liquid removal from the mold during the drying process.

In the first stage of drying, the casting mold is completely saturated with liquid. This stage of drying is commonly referred to as the "constant rate stage." This drying stage is characterized by evaporation of liquid at the surface of the wet mold at a constant rate. Liquid is transported by capillary action from the interior of the mold to the surface at a rate generally equivalent to the rate of evaporative liquid loss. In a standard air drying curve, this stage is characterized by a constant wax pattern temperature close to the ambient wet bulb conditions.

In the second stage of drying, the casting mold is no longer saturated with liquid. Drying is limited by the ease at which liquid transfers to the surface of the mold by capillary action from the interior. This stage is commonly referred to as the "falling rate stage." Liquid will evaporate at a rate which exceeds the rate at which liquid can be transferred to the surface of the mold. Capillary action limits the transport of liquid from the interior of the mold to the surface. In a standard air drying curve, this stage is characterized by the increasing wax pattern temperature.

In the third stage of drying, capillary liquid movement from the interior to the surface of the mold no longer occurs. Liquid loss or removal from the mold occurs by evaporation of liquid at the interior of the mold, and then diffusion of the resulting vapor through the interior of the mold to the surface. This stage of drying is characterized by the flattening of the wax pattern temperature change (or conductivity change slope as measured).

Figure 11:
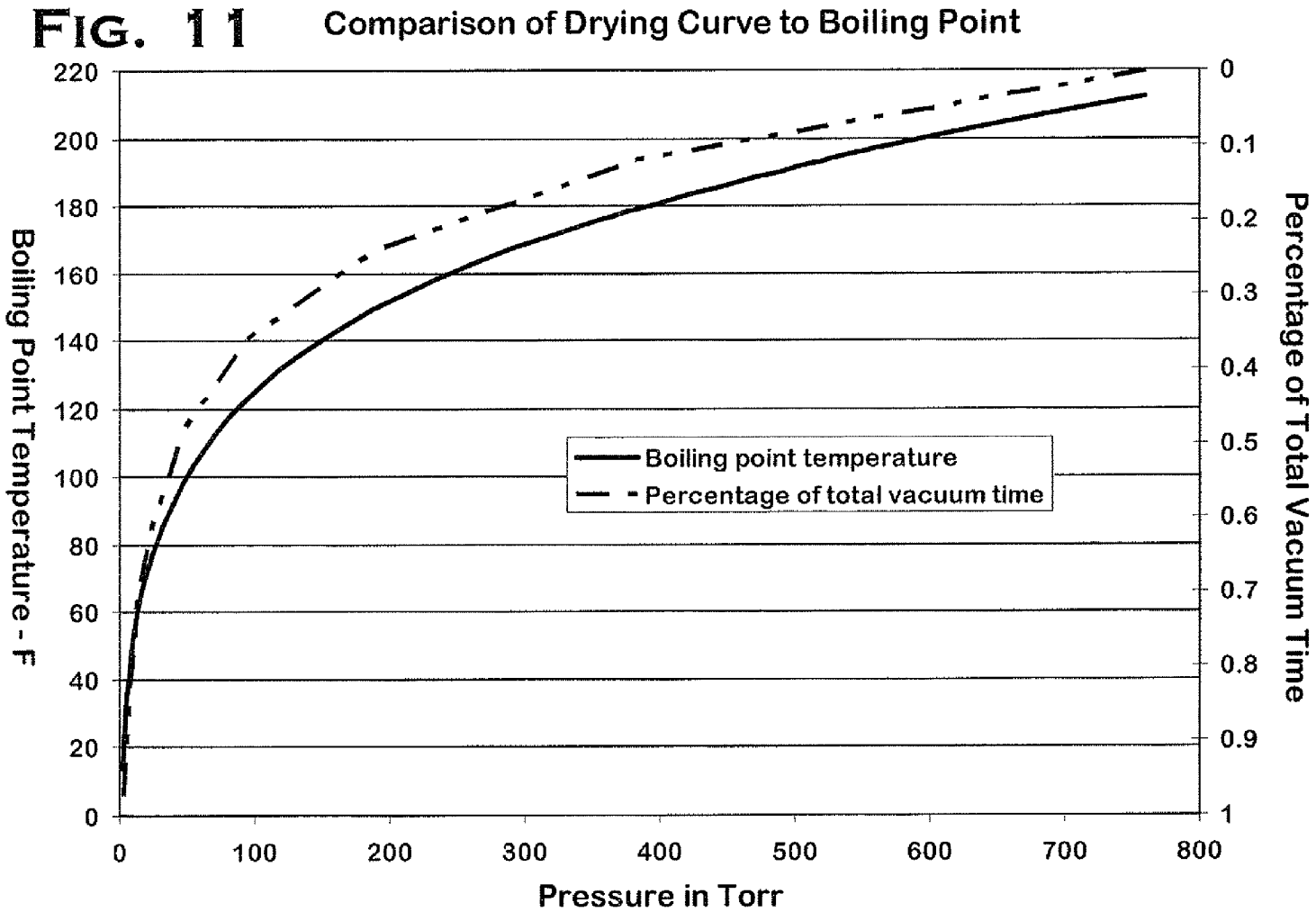
FIG. 11 shows a graph of a preferred vacuum shell drying curve compared to the boiling point of water at various pressures.

In vacuum-desiccant drying according to the present invention, the ideal vacuum curve is closely related to the drying stage and the absolute boiling point of water (when used as the solvent in the binder/solvent part of the slurry). FIG. 11 is a graph comparing the vacuum drying curve to the boiling point of water at decreasing pressure (note pressure is shown in Torr (same as mm Hg) with 760 Torr being atmospheric pressure). As can be seen on the attached curve shown in FIG. 1, the boiling point of water decreases by the natural logarithm of absolute pressure (going from right to left with percentage of total vacuum time increasing to 100% at bottom of graph). The boiling point temperature begins to drop off sharply around 190 Torr (22" Hg). It is desirable the vacuum level is not reduced below this level (i.e. the boiling point) during the first stage of drying because heat loss from the mold (and wax pattern) due to evaporation will quickly exceed that of the heat gain given back to the mold when the water is adsorbed by the desiccant. This would lead to a large imbalance of the heats and excessive drop in wax pattern temperature which may damage the pattern. Preferably, the vacuum level used in the vacuum-desiccant system according to the present invention remains at or above, and preferably does not fall below the boiling point of water for the entire vacuum curve as shown by the dashed line in FIG. 11.

The shape of the ideal vacuum curve is essentially the same for drying each successive layer of the mold (see, e.g. FIG. 11), thereby forming a family of curves shaped similarly to the curve shown in FIG. 11. The difference in drying each mold layer is the total time that the mold is under vacuum. The first few layers require only a very short vacuum drying time in contrast to successive mold layers which would require a longer vacuum drying time to sufficiently harden the shells for further dipping or finally metal casting. The vacuum level can therefore be changed more quickly for the first few layers, but the overall shape of the drying curve would be essentially the same as for the last mold layer. Another way to look at this is from the percentage of total vacuum time allotted to each drying segment of the vacuum curve (see FIG. 11 and Table 1 below). The percentages of vacuum drying time allotted for each corresponding pressure drop (i.e. vacuum increase) would be essentially the same for each layer, but the total vacuum time required to dry the mold increases as more layers are applied for reasons already explained herein.

As seen on the graph shown in FIG. 11, the boiling point curve is fairly flat and linear from atmospheric pressure to around 190 Torr (22.5" Hg). This portion of the curve allows for rapid pressure changes without an adverse large wax temperature decrease. In one embodiment according to the present invention, the vacuum curve selected for the vacuum-desiccant mold drying process preferably uses about 24% of the total vacuum time for this first vacuum drying segment from 760 to 190 Torr even though this comprises 75% of the pressure drop/vacuum increase (see Table 1 below). Accordingly, the vacuum is preferably applied at a rate which produces this result, and preferably the other corresponding pressure drop-vacuum cycle time durations shown in Table 1 below.

TABLE 1

| | Drying stage pressure (Torr) | | | | | | | |
|---|---|---|---|---|---|---|---|---|
| | 760 to 380 | 380 to 190 | 190 to 95 | 95 to 47 | 47 to 23 | 23 to 11 | 11 to 6 | 6 to 1 |
| Percentage of total vacuum time | 11.9 | 23.9 | 31.8 | 47.9 | 61.2 | 72.3 | 86.1 | 1 |

The second vacuum drying segment extends from around 190 Torr to 47 Torr. This segment again uses about an additional 24% of the total vacuum time, but only drops the pressure about 19% (i.e. cumulatively now about 48% of the total vacuum time used thus far for a total pressure drop of about 94% for both the first and second vacuum drying segments combined). The third and final vacuum drying segment extends from around 47 Torr to 1 Torr (lowest the test vacuum system would go). This segment uses about 52% of the total vacuum time to drop the pressure by 6% (i.e. cumulatively now 100% of the total vacuum time for all three vacuum drying segments combined). Other percentages may be determined from Table 1.

Variable Vacuum Tests

It should be noted that the level of vacuum necessary to effectively dry mold 60 and yet maintain an appropriate heat balance in vessel 20 may be varied over the course of the drying cycle as an increasing amount of water is removed from the mold with time. Accordingly, applying a high vacuum during the early stages of the shell drying process may overcool mold 60 because the water removal rate and hence the corresponding evaporative cooling rate will both be high. Accordingly, the vacuum pumping system in one embodiment preferably includes the capability of varying the level of vacuum in vessel 20 to create and control the vacuum profile to that necessary to balance the heats of adsorption and cooling. Such capability may be created by the use of appropriate control valves, variable speed vacuum pump motor, or other suitable means. In some embodiment, the vacuum level may be controlled by a programmable logic controller (PLC) or a "ramp and soak" type controller commonly used in the industry.

Figure 8:
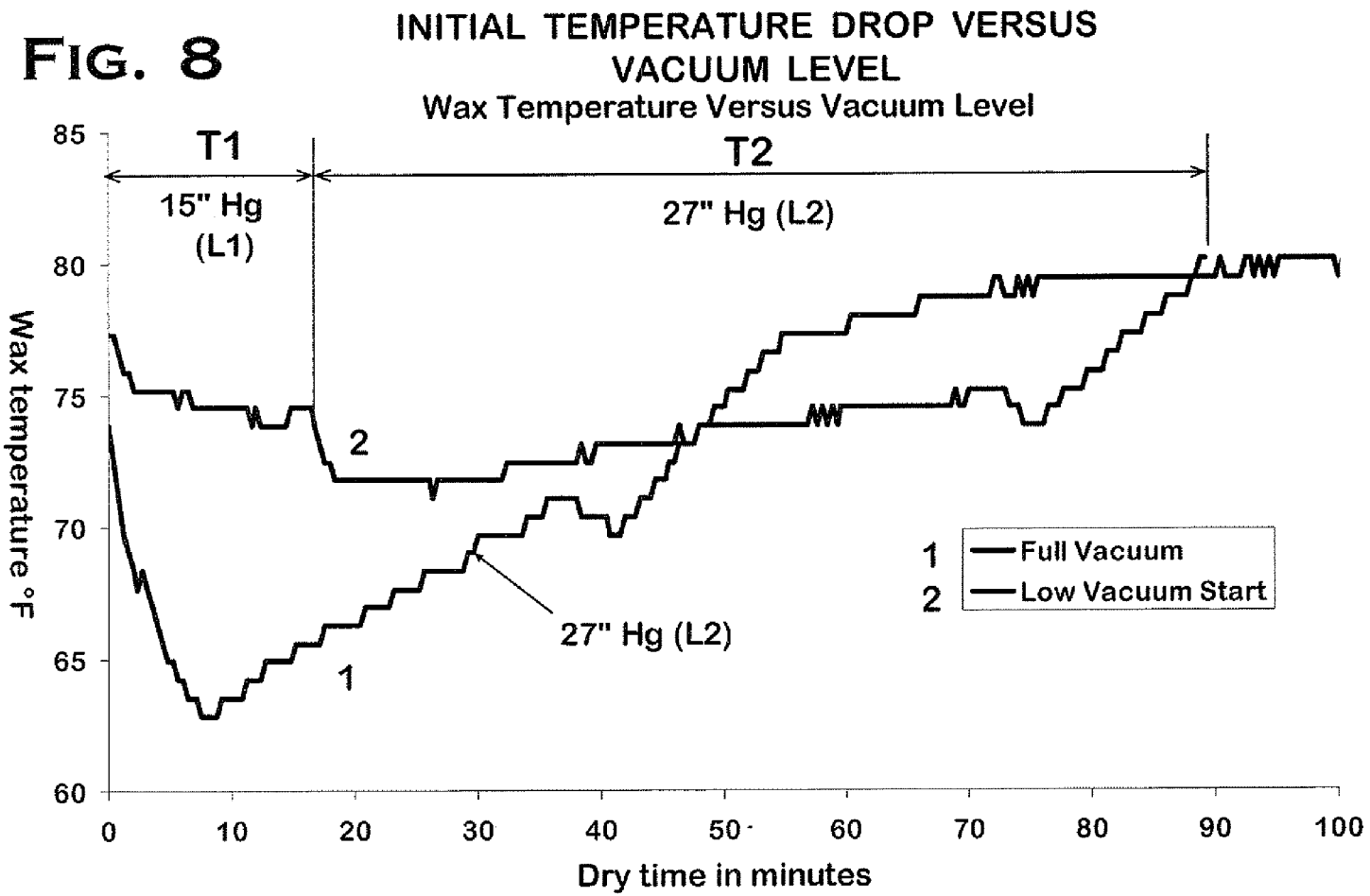
FIG. 8 shows a graph comparing the effect of two-level variable vacuum versus constant vacuum on wax pattern temperature using the preferred shell or mold drying system and method according to the present invention.

Referring to FIG. 8, a graph is shown indicating the results of tests conducted with the vacuum-desiccant mold drying system to evaluate the effect of varying vacuum levels in vessel 20 on wax pattern temperature during the drying cycle. Curve 1 depicts a constant full level vacuum applied to vessel 20 as conventionally used in the art. Curve 2 depicts the results of varying vacuum levels, which in this embodiment uses a two-stage level vacuum in connection with the vacuum-desiccant mold drying system according to the present invention. In a preferred embodiment, the vacuum pumping system in the Curve 2 scenario produces an initial first vacuum level L1 to which vessel 20 is constantly subjected to for a given first period of hold time T1 at the start of the mold drying cycle. Time period T1 corresponds to the presence of an initially higher water content in mold 60. The vacuum level preferably is then relatively abruptly increased to a constant second vacuum level L2 for a given second period of hold time T2, which in one embodiment is preferably at least as long as hold time T1. Preferably vacuum level L2 is greater or higher than level L1. Time period T2 corresponds to presence of a lower water content in mold 60, following a higher water content during period T1 during the vacuum drying process. In one possible scenario that was tested, as shown in FIG. 8 by way of representative example only, L1 was held at about 15" Hg and L2 about 27" Hg. It will be appreciated, however, that vacuum levels L1 and L2 may be any suitable amount and will be dictated by factors such as the shell thickness and configuration, type of desiccant used, etc. Accordingly, the invention is not limited to the use of any particular vacuum levels. Higher drying rates occur at vacuum levels of about 25" Hg and above. Accordingly, L2 preferably may be at least about 25" Hg. L1 may be any suitable vacuum level from 0" Hg to about 25" Hg. It should be noted that FIG. 8 also portrays a typical vacuum-desiccant drying system characteristic curve having an initial temperature drop (heat of evaporation>heat of adsorption from desiccant) followed by a temperature increase (heat of adsorption>heat of evaporation) to higher than ambient conditions, This is attributable to the fact that the vacuum-desiccant system is a net heat gain system, as further described elsewhere herein.

The graph in FIG. 8 indicates a larger initial drop of about 11-12 degrees F. in wax temperature for constant full vacuum Curve 1 in contrast to an initial drop of only about 5-6 degrees F. for variable vacuum Curve 2. Overall, considering the initial wax temperature drop caused by evaporation due to use of an initial air drying period for both Curves 1 and 2 prior to staring the vacuum (not shown in FIG. 8), the total wax temperature swing or change for Curve 1 was about 15-20 degrees F. using constant vacuum versus about 7-8 degrees F. for Curve 2 using a variable vacuum with lower initial vacuum level L1. Accordingly, controlling the vacuum level using a variable vacuum system beneficially allows greater control of the heat balance in vessel 20 to minimize the initial wax temperature drop during the drying cycle. Advantageously, this reduces thermal stresses in the ceramic mold, which helps guard against damaging the mold. Preferably, the initial vacuum level L1 is selected to keep the initial temperature drop in the wax to acceptable levels which avoid damaging the mold. The initial hold time T1 at vacuum level L1 is preferably selected to be long enough to remove sufficient moisture from the ceramic mold so that increasing the vacuum level to a second preferably higher level L2 will not result in a substantial drop in wax temperature, while at the same time not unnecessarily increasing the total time required to dry the mold.

Although in some situations it may be desirable to vary the vacuum level during the drying cycle to prevent damaging the wax patterns, it will be appreciated that in other situations applying a constant vacuum to vessel 20 may produce acceptable results. Accordingly, the invention and preferred vacuum drying method is not limited to the use of variable vacuum levels alone. In addition, it will be appreciated that more than two vacuum levels L1, L2 may be used during the drying cycle to further control swings in wax temperature.

Figure 12:
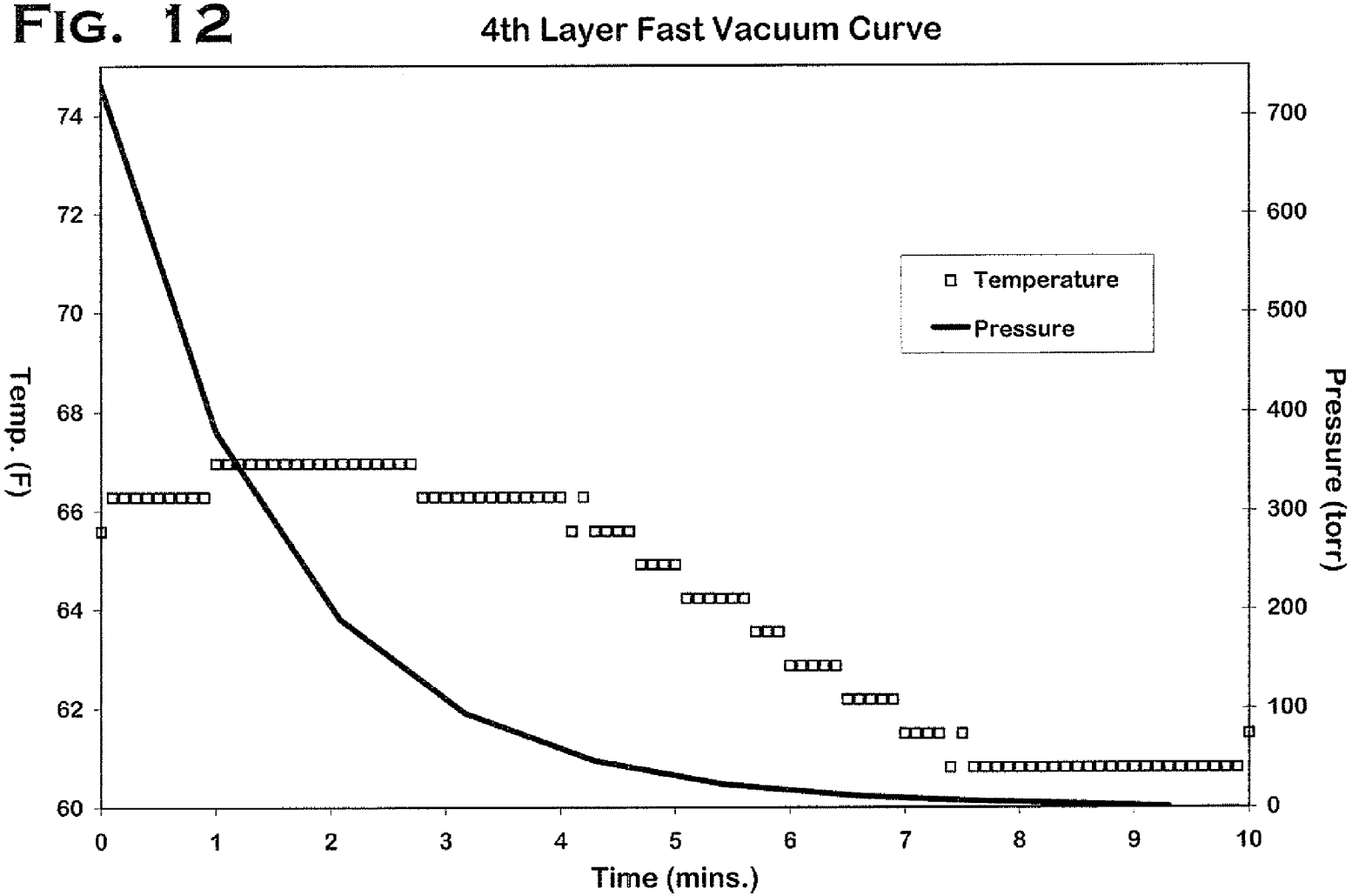
FIG. 12 shows a graph comparing wax pattern temperature and vacuum chamber pressure versus a relatively fast time rate of change of the vacuum level.
Figure 13:
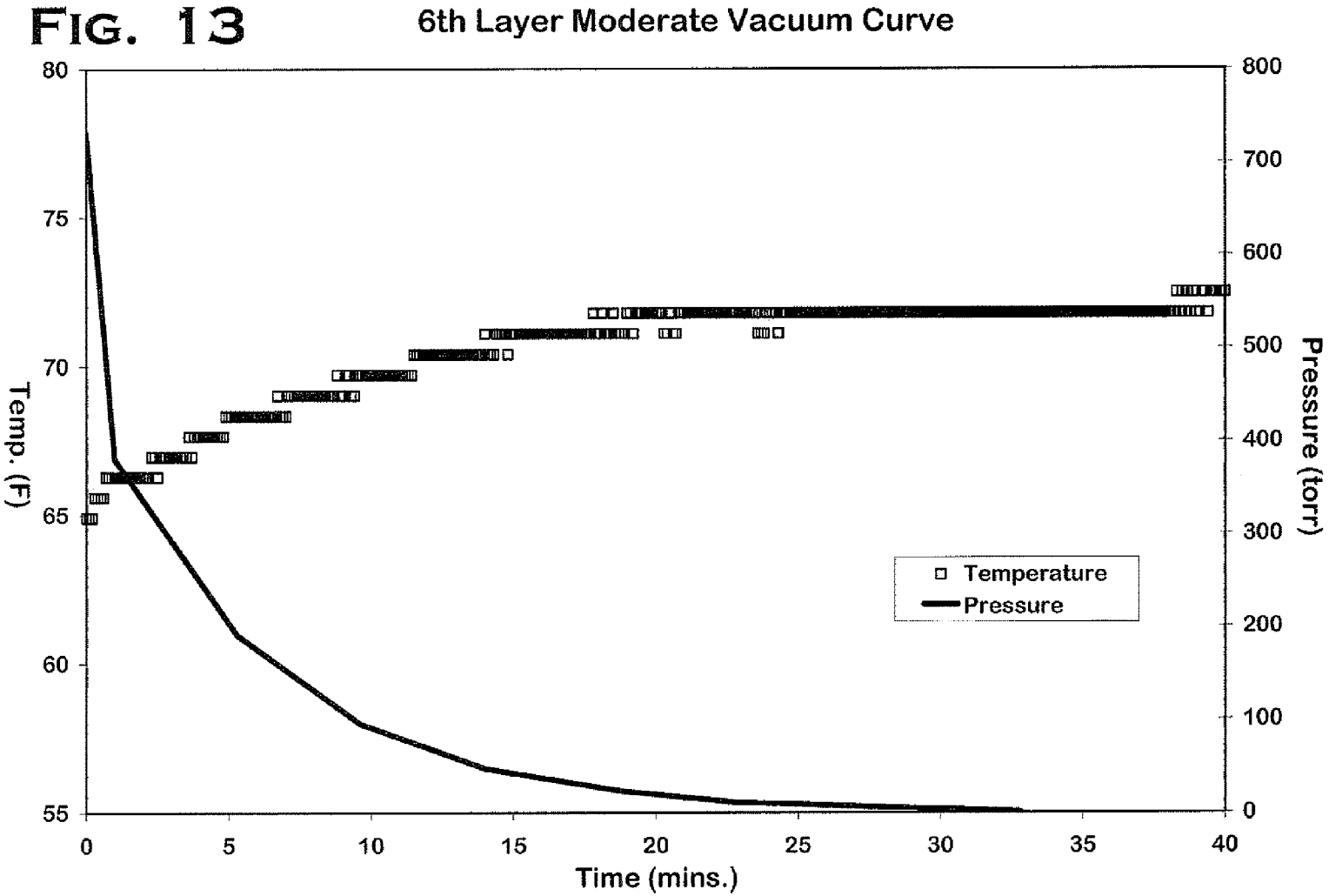
FIG. 13 shows a graph comparing wax pattern temperature and vacuum chamber pressure versus a relatively moderate time rate of change of the vacuum level.

In contrast to the discrete two-stage or level vacuum drying described herein in connection with FIG. 8, FIGS. 12 and 13 show the results of drying tests comparing the application of a representative fast rate and a moderate rate vacuum respectively to the casting mold in connection with the vacuum-desiccant mold drying system according to the present invention. In this embodiment, a controlled gradually increasing vacuum profile was used as represented and approximated by the common logarithmic curve (i.e. decadic logarithm or base 10 logarithm) as shown wherein the vacuum pressure increases logarithmically with time duration of the vacuum application. The vacuum was applied such that the curve gradually flattens when approaching the maximum vacuum used for drying the molds. Although the vacuum pressure curves for FIGS. 12 and 13 are both logarithmic in shape, the time required to travel along each curve from atmospheric pressure (760 Torr) to full vacuum (about 1 Torr in this instance) may be varied which produces differing effects on wax pattern temperature as shown by FIGS. 12 and 13. Each casting mold in FIGS. 12 and 13 was subjected to about 15 minutes of initial air drying prior to applying the vacuum. The air drying step is responsible for the initial temperature decrease from ambient to the start of the vacuum shown in Tables 2 and 3 below (with starting wax pattern temperature corresponding to ambient temperature) as liquid from the surface of the casting mold begins to evaporate and cools the mold. In both cases shown in FIGS. 12 and 13, the initial temperature drop resulting from the air drying step was about 10 degrees F. from ambient.

FIG. 12 and Table 2 below show the results of drying a 4th mold layer under application of a relatively fast vacuum rate applied to the vacuum-desiccant vessel. Vacuum was applied from atmospheric pressure of 760 Torr to a full vacuum of about 1 Torr in about 9 minutes, at a total average vacuum increase rate of about 82 Torr/Minute. As shown, the corresponding decrease in wax pattern temperature was 5.5 degrees F. overall from start of the vacuum to stop. The ending temperature of 60.8 degrees F. at 1 Torr represents a total decrease of 14.4 degrees F. from initial ambient conditions at 75.2 degrees F., which corresponds to the wax pattern temperature before the air drying step. This is considered a large temperature decrease, which is not a desirable result because excessive drops in wax temperature of this magnitude may cause wax pattern cracking or prime coat liftoff problems. It should be noted that the vacuum level increase from atmospheric pressure (760 Torr) to 95 Torr did not result in a net change in wax pattern temperature from the time when vacuum was first applied to the vacuum vessel. During this period, the vacuum rate of increase was about 210 Torr/Minute. The temperature drop of about 6 degrees F. induced by the vacuum in the drying process occurred in conjunction with the vacuum increase in the drying vessel from a pressure of 95 Torr down to 1 Torr. During this period, the vacuum rate of increase was about 15.3 Torr/Minute. Accordingly, the results in FIG. 12 and Table 2 shows that the use of vacuum-desiccant drying alone is typically not sufficient to maintain the temperature change of the wax pattern during the mold drying process to within acceptable parameters that will prevent pattern damage or prime coat liftoff/separation. Careful control of the time rate of change at which the vacuum is increased and the corresponding vacuum levels are significant factors to proper mold drying using the vacuum-desiccant process described herein.

TABLE 2

| $4^{th}$ Layer Fast Drying Curve - Ambient Temp 75.2 F. | | |
|---|---|---|
| Time (Mins.) | Pressure - Torr | Wax Temperature - F. |
| 0 | 760 | 66.3 |
| 1 | 380 | 66.9 |
| 2.08 | 190 | 66.9 |
| 3.17 | 95 | 66.3 |
| 4.29 | 47 | 65.6 |
| 5.43 | 23 | 64.2 |
| 6.63 | 11 | 62.2 |
| 7.63 | 6 | 60.8 |
| 9.3 | 1 | 60.8 |

By contrast, as shown in FIG. 13 and Table 3 below for a 6th mold layer case, the positive effects of carefully controlling the rate of change of increasing the vacuum in the drying vessel over time is demonstrated. In this case, a more moderate vacuum rate was used to gradually increase the vacuum level over time from atmospheric pressure (760 Torr) to a maximum vacuum (1 Torr) over about a 24 minute total period, instead of less than 10 minutes as used in the fast rate vacuum described above. The associated average total vacuum increase rate was about 32 Torr/Minute for the moderate vacuum curve in contrast to 82 Torr/Minute for the fast vacuum curve discussed above. The vacuum level increase from atmospheric pressure (760 Torr) to 95 Torr was more gradual, at a rate of increase of about 69.3 Torr/Minute compared to 210 Torr/Minute for the fast rate curve. The vacuum level increase in the drying vessel from a pressure of 95 Torr down to 1 Torr occurred at a rate of about 6.6 Torr/Minute compared to about 15.3 Torr/Minute for the fast rate curve. Advantageously, using the more moderate vacuum rate shown in FIG. 13 and Table 3, the wax pattern temperature actually increases by about 7 degrees from the start over the entire vacuum step with an ending wax temperature of 71.8 degrees F. This is a desirable result because the wax pattern temperature gradually returns to close to its original starting ambient temperature of 74.5 degrees F., thereby recovering from the initial wax temperature drop associated with the initial air drying step. Preferably, the maximum wax temperature drop is within about 5 degrees F. of starting ambient temperature, and more preferably is within 3 degrees F. Also preferably, the wax temperature drop does not decrease during the vacuum application by more than about 5 or 6 degrees F. from atmospheric pressure to maximum vacuum level in other embodiments. Careful control of the vacuum level increase rate as described herein allows control of the temperature drop along with controlling the level of retained moisture, if any, in the desiccant. Accordingly, the longer more gradual rate of applying the vacuum to the mold drying chamber eliminated the large temperature decrease observed in FIG. 12 above with the fast rate vacuum process. Although a goal of the vacuum-desiccant mold drying system is to dry the molds as quickly as possible to increase production rates, this must be counter-balanced by avoiding excessive decreases in wax temperature which may damage the wax patterns. Preferably, with additional reference to FIG. 11, the vacuum level is controlled such that the vacuum level used in the vacuum-desiccant system according to the present invention remains at or above, and preferably does not fall below the boiling point of water for the entire vacuum curve.

TABLE 3

| $6^{th}$ Layer Moderate Vacuum Cycle - Ambient Temp 74.5 F. | | |
|---|---|---|
| Time (Mins.) | Pressure - Torr | Wax Temperature - F. |
| 0 | 760 | 64.9 |
| 1 | 380 | 66.3 |
| 5.3 | 190 | 68.3 |
| 9.6 | 95 | 69.7 |
| 14 | 47 | 70.4 |
| 18.8 | 23 | 71.1 |
| 22.8 | 11 | 71.8 |
| 27.8 | 6 | 71.8 |
| 23.8 | 1 | 71.8 |

According to another aspect of the invention, a computerized control system including a programmable logic controller (PLC) implementing appropriate software and control logic may be used to control and vary the vacuum levels in vessel 20 for the mold drying process. Commercially-available monitoring probes such as thermocouples, thermistors, etc. may be embedded in the wax pattern to measure electrical voltages and generate input signals to the control system that are indicative of wax temperature and moisture content of the ceramic molds during the vacuum-desiccant process. This data may then be processed by the control system to manage and vary the vacuum level over time in vessel 20 as required to maintain the wax within predetermined and preprogrammed temperature limits. Accordingly, the heat balance in vessel 20 between the heat of evaporative and heat of adsorption may be controlled automatically by the control computer system to optimize temperature changes in the wax and mold drying times. It is well within the ambit of those skilled in the art to design and implement such a control system with appropriate software for controlling vacuum levels in vessel 20.

Mold Drying Comparison Tests

Mold drying tests were conducted using the basic vacuum-desiccant system shown in FIGS. 1-5 to compare the performance of the preferred vacuum-desiccant system and method with some conventional air-only systems for drying casting shells or molds. Test ceramic shells were prepared that included a plain or "stick" section without apertures and a wax pattern with a deep blind hole. Electrical measurement probes were attached to the wax pattern and shell to measure electrical resistance of the wax, stick section, and hole. This provided data indicative of the temperature of the wax and moisture content at the stick section and hole. As the casting shells dry, the measured voltage (and corresponding conductivity) drops with a reduction in water content of the shells, which correlates to the level of dryness of the shell. Sorbead desiccant was used for the drying comparison tests.

the significantly longer drying times required for drying each successive shell layer that is formed.

Table 4 below shows the results of mold drying comparison tests performed comparing the vacuum-desiccant mold drying system according to the present invention with a baseline standard of conventional air drying for a 7-layer mold. In this embodiment, the ceramic slurry coating was first air dried for a 14 minutes prior to the vacuum-desiccant stage of the drying process to prevent stucco adhered to the slurry from being dislodged during the step of encapsulating the casting molds in the desiccant. As shown, the total drying time for the casting mold was 284 minutes in contrast to the significantly longer 4,050 minutes for conventional air drying. Accordingly, the time and production cost savings resulting from quicker mold drying process times are evident. This allows about 14 molds to be prepared for casting parts in about the same time it takes to prepare a single mold using conventional air drying. The results for each individual layer 1-7 can be observed below.

TABLE 4

| | | Drying Method | | | | | | | |
|---|---|---|---|---|---|---|---|---|---|
| | | 1st | 2nd | 3rd | 4th | 5th | 6th | Final | Total |
| | | Air drying | | | | | | | |
| | | 150 | 150 | 150 | 240 | 240 | 240 | 2880 | 4050 |
| Vacuum desiccant | Air dry time (minutes) | 14 | 14 | 14 | 14 | 14 | 14 | 14 | 98 |
| | Vacuum dry time (minutes) | 6 | 6 | 18 | 20 | 34 | 36 | 66 | 186 |
| | Total time (minutes) | 20 | 20 | 32 | 34 | 48 | 50 | 80 | 284 |

Figure 6A:
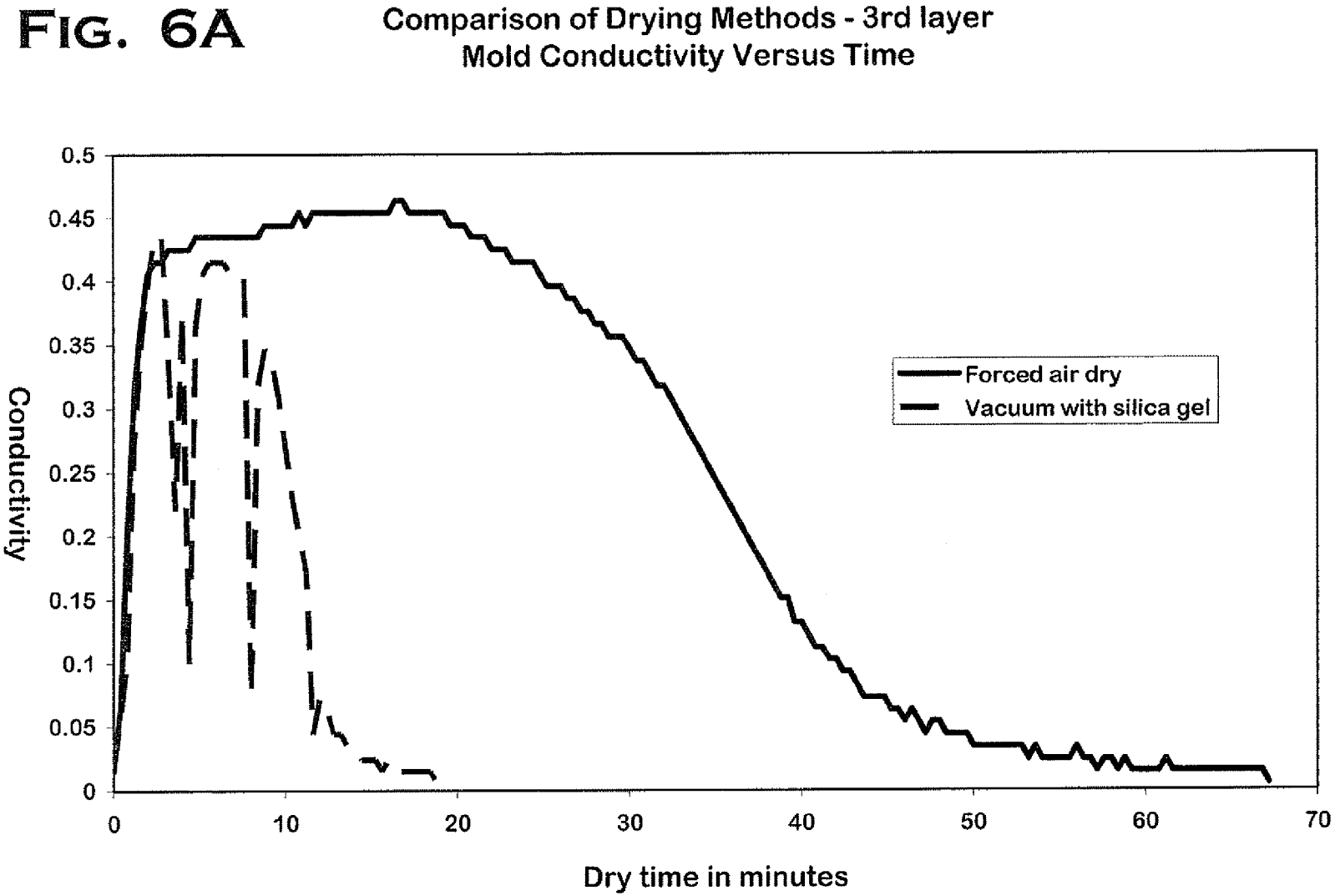
Figure 7A:
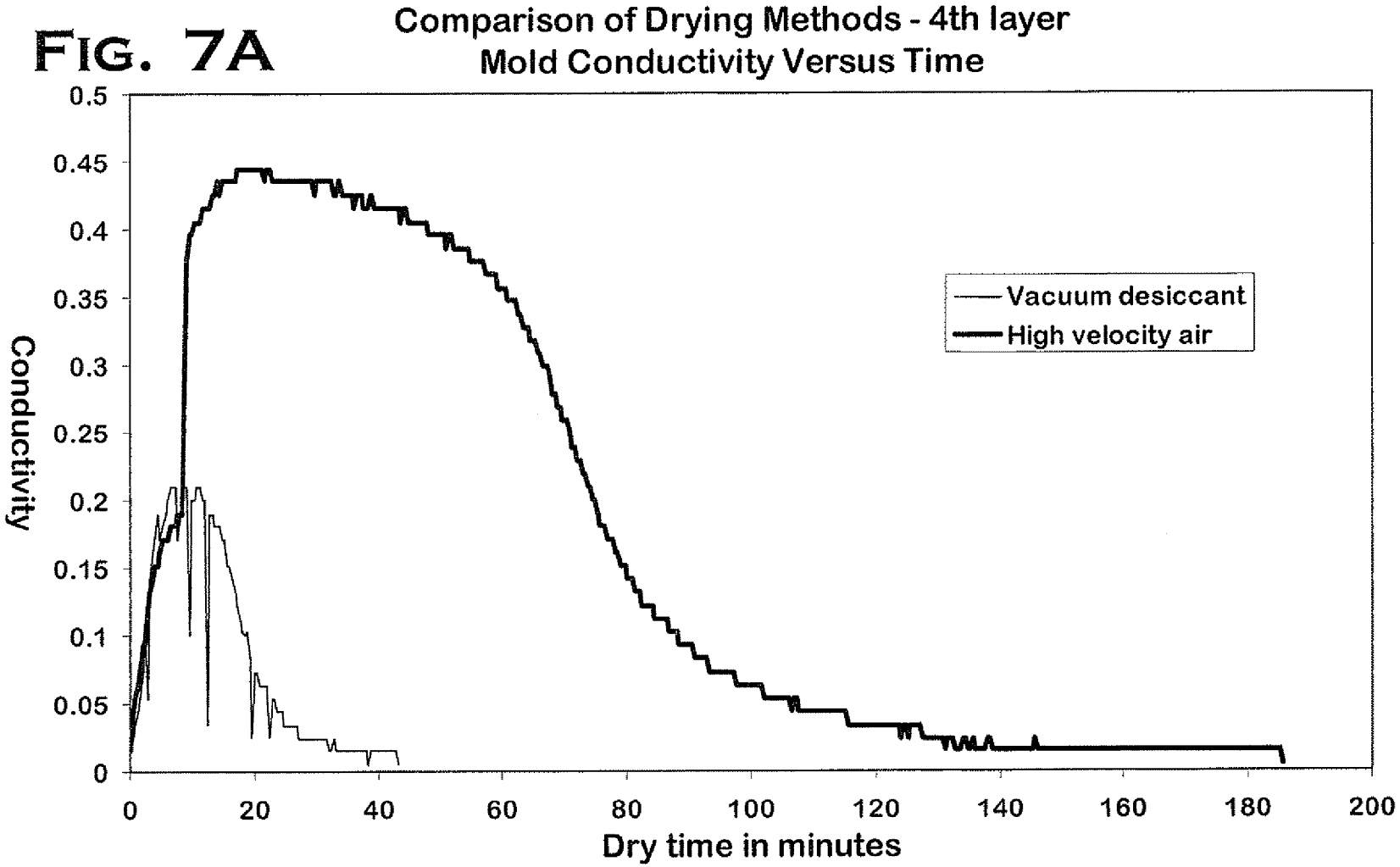

FIGS. 6A-B and 7A-B contain graphs and tables showing the test results for the 3$^{rd}$ and 4$^{th}$ shell layers respectively using standard airflow, high velocity airflow, and the vacuum-desiccant system methods. FIG. 6B also shows the results for mold drying using desiccant alone at atmospheric pressure conditions. In a typical 7-layer mold, these two layers would represent the intermediate layer with layers 1-2 having shorter drying times and 5-7 longer drying times than layers 3 and 4. The graphs shown in FIGS. 6A and 7A only depict data for the vacuum-desiccant system method of the preferred embodiment and forced-high velocity air method, the latter being the current industry standard.

As shown in the charts and tables of FIGS. 6A, 6B, 7A, and 7B, the preferred vacuum-desiccant method according to principles of the present invention significantly reduced drying times for the 3$^{rd}$ and 4$^{th}$ shell layers. For the holes which are more difficult to dry, hole drying times for the 3$^{rd}$ and 4$^{th}$ layers using the preferred vacuum-desiccant method were only 19% and 11% of the current industry standard using airflow alone. For the 3$^{rd}$ shell layer, shell holes using the vacuum-desiccant method dried in 15 minutes in contrast to 79 minutes for the standard airflow method and 57 minutes for the high velocity airflow method. It will also be noted that holes dried using only desiccant at atmospheric (non-vacuum) conditions as shown in FIG. 6B took twice as long (30 minutes) to dry than the vacuum-desiccant method. For the 4$^{th}$ shell layer, shell holes using the vacuum-desiccant method dried in 30 minutes in contrast to 276 minutes for the standard airflow method and 132 minutes for the high velocity airflow method. Cumulatively, it will be appreciated that the preferred vacuum-desiccant drying method for a typical 7-layer shell or mold drastically reduces total mold drying time in contrast to other conventional methods. It should be noted that the data for the 3$^{rd}$ and 4$^{th}$ layer shell demonstrates In some situations, it may be difficult to effectively fluidize the desiccant bed due to the size and/or shape of the particular desiccant being used. For example, a desiccant with a spherical shape and tight distribution may make establishing sufficient backpressure needed to properly maintain a uniformly fluidized bed difficult. According to a preferred embodiment of a vacuum-desiccant system, a non-fluidizing desiccant system and method may be used as illustrated in FIG. 9A-D. Referring to FIG. 9A-D, a vacuum vessel 100 is provided that eliminates the air plenum 30 and intermediate porous plate 40 shown in the system shown in FIG. 1. In addition, a desiccant feed system 110 preferably including an external regeneration system 112 is provided.

Continuing with reference to FIG. 9A-D, the preferred vacuum-desiccant system includes vacuum vessel 100 which has a closeable and sealable lid 102 and lid operator 103, which may be attached to the vessel in some embodiments. Lid operator 103 may be operated manually, electrically, or pneumatically in some possible embodiments. Preferably, lid 102 may be sufficiently sealed to vessel 100 by any suitable means (e.g., gaskets, seals, tight fit, clamps, etc.) to allow a vacuum to be established in the vessel. Vessel 100 may be any suitable configuration, such as square, rectangular, round, or other depending on the number and size of molds intended to be dried in the vessel. Vessel 100 is preferably provided with a sloped bottom 104 to facilitate in removing desiccant from the vessel. The vacuum-desiccant system further includes a hanger 101 which preferably is configured and structured to removably engage a mold assembly 105 structured to hold and support a plurality of individual molds 60. Hanger 101 is operable to lower and raise lower mold assembly 105 and molds 60 into vessel 100. Hanger 101 may be operated by any suitable means, such as manually, electrically via an electric motor, or pneumatically in some possible embodiments.

Referring to FIG. 9A-D, desiccant feed system 110 is preferably operable to transport and convey desiccant from and to vessel 100. In some possible embodiments, without limitation, desiccant feed system 110 may be manual, a pneumatic conveying system, or a bucket and/or belt conveyor type system. However, desiccant feed system 110 may be comprised of any suitable type of commercially-available material handling system that is conventionally used to transport granular type materials such as desiccants.

Referring to FIG. 9A-D, a desiccant regeneration system 112 is provided, which in one possible preferred embodiment is external to vessel 100, and more preferably operably associated with the desiccant feed system 110 in some embodiments. The desiccant regeneration system 112 may be any suitable type of commercially equipment or system so long as the temperature of the desiccant can be raised to evaporate retained liquid (e.g. water, alcohol, etc.). Preferably, desiccant regeneration system 112 is operable to perform complete or partial regeneration of the desiccant for reasons described elsewhere herein. In one possible embodiment, the desiccant regeneration system preferably uses heated air to liberated retained liquid from the desiccant.

A preferred method of drying casting molds using the vacuum-desiccant system shown in FIGS. 9A-D will now be described with reference to those figures.

Step 1. The drying process begins with an initial partial air dry of molds 60, at ambient atmospheric conditions, which have been dipped in ceramic slurry (either with or without a subsequent dip in refractory stucco). In one possible embodiment as shown in FIG. 9A, hanger 101 may be used to suspend mold assembly 105 and molds 60 above vessel 100 for the partial air dry, which preferably may be at least about 10 minutes in length or more. Alternatively, molds 60 may be air dried remotely from vessel 100. With continuing reference to FIG. 9A, vacuum vessel 100 is preferably either completely emptied of desiccant or partially emptied of desiccant 50 so that mold 60 will only partially contact a bed of desiccant when lowered into the vessel.

Step 2. Referring to FIG. 9B, mold assembly 105 and molds 60 are lowered into and positioned in vessel 100. Desiccant feed system 110 is next actuated by any suitable means to fill vessel 100 with the desired desiccant 50 to a level necessary to establish a desiccant bed that effectively encapsulates molds 60 (see, e.g. FIG. 9C). Alternatively, if a manual desiccant feed or transport system is used, desiccant 50 may be added to vessel 100 by hand.

Figure 9C:
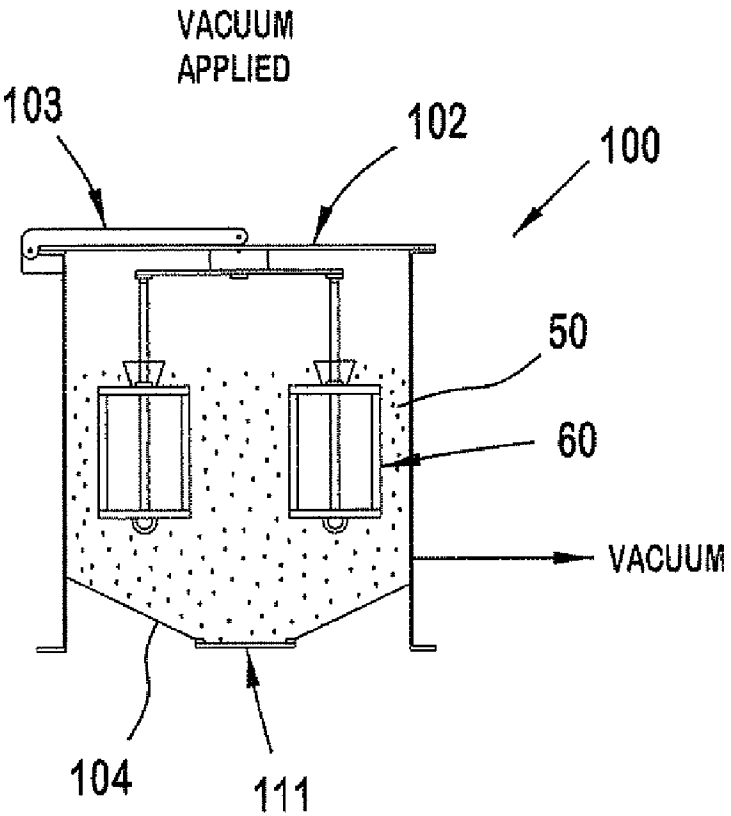

Step 3. Referring to FIG. 9C, lid 102 is closed and sealed to vessel 100. A vacuum is then applied to vessel 100 by a vacuum system in the same manner previously described herein with reference to the system shown in FIGS. 1-5. The vacuum is held for a sufficient hold time to dry molds 60.

Step 4. Referring still to FIG. 9C, the vacuum on vessel 100 may be broken by any suitable means and lid 102 opened. Mold assembly 105 may then be raised above vessel 100 using hanger 101 to lift molds 60 out of the bed of desiccant 50. Mold assembly 105 may then be vibrated mechanically or manually to loosen and remove any desiccant 50 off of molds 60 which might still be adhered thereto. The desiccant would fall back into vessel 100 for reuse. Valve 111 is then opened and the desiccant feed system is activated to partially or completely remove desiccant 50 from vessel 100 (see FIG. 9A) prior to inserting the next wet dipped mold. Alternatively, prior to raising mold assembly 105, valve 111 on the bottom of vessel 100 may instead be opened first to remove the desiccant from the vessel using the desiccant feed system 110 (or by manual means if a manual desiccant feed or transport system is employed). Mold assembly 105 would then be raised and vibrated to loosen and remove any desiccant 50 still adhering to molds 60.

If required, the regeneration system 112 may be used being mold drying runs to partially or completely regenerate the desiccant 50 in the same manner described elsewhere herein. The mold drying and vessel fill sequences starting with Step 1 may then be repeated for a new wet dipped mold.

It will be appreciated that the entire mold handling, dipping, and vacuum drying processes described herein, or any combination of portions thereof, may be performed manually or automated through the use of a programmable computer system and controllers. It will further be appreciated that the vacuum-desiccant drying system and method described herein may be used with equal benefit in other types of non-investment casting processes.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, components, and otherwise, which are particularly adapted to specific environments and operative requirements, without departing from the spirit or essential characteristics thereof. In addition, numerous variations in the methods/processes described herein are possible, including the number, order, or inclusion of additional steps performed in practicing the methods/processes. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

The invention claimed is:

1. A method for drying casting molds comprising:

providing a wet casting mold comprised of a meltable pattern having a ceramic liquid slurry coating thereon;

encapsulating the casting mold in a desiccant material;

applying a first constant vacuum level to the desiccant and casting mold;

holding the first vacuum level for a first period of hold time;

applying a second constant vacuum level to the desiccant and casting mold higher than the first vacuum level, the second vacuum level being different than the first vacuum level; and holding the second constant vacuum level for a second period of hold time longer than the first period of hold time to produce a hardened shell.

2. The method of claim 1, wherein the second vacuum level is higher than the first vacuum level.

3. The method of claim 1, further comprising:

dipping the wet casting mold into refractory stucco wherein the stucco adheres to the slurry coating; and air drying the casting mold at atmospheric pressure for a period of time sufficient to prevent the majority of the stucco from being dislodged from the casting mold during the encapsulating step.

4. The method of claim 3, wherein the air drying step is at least 10 minutes in duration.

5. The method of claim 1, further comprising fluidizing the desiccant prior to the encapsulating step to promote uniform encapsulation of the casting mold in the desiccant material.

6. The method of claim 1, further comprising selecting the first and second vacuum levels wherein the pattern undergoes a maximum total temperature drop during the first and second vacuum levels which does not exceed 5 degrees F. from an initial starting temperature measured at the start of the first vacuum level applying step.

7. A method for drying casting molds comprising:

providing a casting mold comprised of a meltable pattern coated with a ceramic slurry containing a liquid solvent and a binder;

placing the casting mold in a chamber;

encapsulating the casting mold in a desiccant material;

sealing the chamber sufficient to pull a vacuum in the chamber;

applying a variable vacuum to the chamber, the vacuum being controlled so that the vacuum gradually increases from atmospheric pressure to a maximum vacuum pressure such that the meltable pattern has a temperature that does not decrease more than 5 degrees F. from atmospheric pressure to maximum vacuum pressure.

8. The method of claim 7, wherein the vacuum is applied to the casting mold for a total vacuum time measured from atmospheric pressure to the maximum vacuum pressure, and wherein the vacuum is applied at a rate such that approximately 24% of the total vacuum time is used to increase the vacuum by approximately 75%.

9. The method of claim 7, wherein the rate at which the vacuum increases from atmospheric pressure to the maximum vacuum pressure follow a logarithmic vacuum curve wherein the time rate of change at which the vacuum level increases from atmospheric pressure to the maximum vacuum pressure over time gradually decreases.

10. The method of claim 7, wherein the meltable pattern has a final temperature at the maximum vacuum pressure that is not less than about 5 degrees below a starting ambient temperature of the pattern at atmospheric pressure.

11. The method of claim 7, further comprising air drying the casting mold at atmospheric pressure for at least 10 minutes to partially gel the binder before the encapsulating step.

12. The method of claim 7, wherein the desiccant is unheated at about ambient room temperature prior to the encapsulating step.

13. The method of claim 7, wherein the encapsulating step includes fluidizing the desiccant material and immersing the casting mold into the desiccant material.

14. The method of claim 7, wherein the desiccant is partially regenerated to control the temperature of the meltable pattern.

15. A method for forming and drying an investment casting mold comprising:

providing a wax pattern of a metal part to be cast;

applying a ceramic slurry coating to the pattern containing a liquid solvent to define a wet casting mold;

encapsulating the casting mold with a desiccant material;

applying a vacuum to the casting mold for a total vacuum time measured from atmospheric pressure to a maximum vacuum pressure, wherein the vacuum is applied at a rate such that approximately 24% of the total vacuum time is used to increase the vacuum by approximately 75% and such that the wax pattern has a temperature that does not decrease more than 5 degrees F. from atmospheric pressure to maximum vacuum pressure.

16. The method of claim 15, further comprising air drying the casting mold for a period of time at atmospheric pressure to partially evaporate some of the liquid solvent from the casting mold prior to applying the vacuum.

17. The method of claim 15, wherein the encapsulating step includes fluidizing the desiccant material and immersing the casting mold into the desiccant material.

18. A method for forming and drying an investment casting mold comprising:

providing a meltable wax pattern of a metal part to be cast;

applying a ceramic slurry coating to the pattern containing a liquid solvent to form a wet casting mold;

fluidizing a bed of unheated desiccant at ambient room temperature;

immersing the casting mold in the bed of desiccant;

drying the casting mold by applying a controlled variable vacuum to the casting mold over a period of time, the vacuum being controlled to gradually increase from atmospheric pressure to a maximum vacuum pressure such that the wax pattern maintains a temperature that does not decrease more than 5 degrees F. from the temperature of the pattern at atmospheric pressure.

19. The method of claim 18, wherein the vacuum is applied to the casting mold for a total vacuum time from atmospheric pressure to the maximum vacuum pressure, and wherein the vacuum is applied at a rate such that approximately 24% of the total vacuum time is used to increase the vacuum by approximately 75%.

20. The method of claim 18, wherein the vacuum is applied to the casting mold for a total vacuum time from atmospheric pressure to the maximum vacuum pressure, and wherein the vacuum is applied at a rate such that approximately 48% of the total vacuum time is used to increase the vacuum by approximately 94%.

21. The method of claim 18, further comprising air drying the casting mold at atmospheric pressure for at least 10 minutes before the immersing step.

22. The method of claim 18, further comprising stopping the fluidizing of the desiccant bed after the immersing step.

* * * * *